US011674674B2

(12) United States Patent
Li et al.

(10) Patent No.: US 11,674,674 B2
(45) Date of Patent: Jun. 13, 2023

(54) TELESCOPIC LAMP

(71) Applicant: GUANGDONG SIRUI OPTICAL CO., LTD., Zhongshan (CN)

(72) Inventors: Jie Li, Zhongshan (CN); Zhangxuan Yang, Zhongshan (CN)

(73) Assignee: GUANGDONG SIRUI OPTICAL CO., LTD., Zhongshan (CN)

( * ) Notice: Subject to any disclaimer, the term of this patent is extended or adjusted under 35 U.S.C. 154(b) by 111 days.

(21) Appl. No.: 17/445,333

(22) Filed: Aug. 18, 2021

(65) Prior Publication Data

US 2022/0299195 A1 Sep. 22, 2022

Related U.S. Application Data

(63) Continuation of application No. PCT/CN2021/106636, filed on Jul. 16, 2021.

(30) Foreign Application Priority Data

Mar. 19, 2021 (CN) ..... 202110300554.3
Jun. 28, 2021 (CN) ..... 202110724118.9

(51) Int. Cl.
*F21V 21/22* (2006.01)
*F21Y 115/10* (2016.01)
*F21Y 103/10* (2016.01)

(52) U.S. Cl.
CPC ..... *F21V 21/22* (2013.01); *F21Y 2103/10* (2016.08); *F21Y 2115/10* (2016.08)

(58) Field of Classification Search
CPC ..... F21V 21/22
See application file for complete search history.

(56) References Cited

U.S. PATENT DOCUMENTS 10,962,208 B1 * 3/2021 Hsu ..... F21S 8/03
2013/0141914 A1 * 6/2013 Lai ..... F21V 21/22 362/249.03
2018/0135849 A1 * 5/2018 Paseta ..... F21V 15/012
(Continued)

FOREIGN PATENT DOCUMENTS

CN 104295995 1/2015
CN 104296033 1/2015
(Continued)

*Primary Examiner* — Eric T Eide
(74) *Attorney, Agent, or Firm* — Loeb & Loeb LLP

(57) ABSTRACT

A telescopic lamp comprising a lamp handle; a first support, having a first light-emitting member disposed thereon; a second support, extending in the same direction as the first support, slidably connected to the first support along a length direction of the first support, and having a second light-emitting member mounted thereon; wherein, the second light-emitting member and the first light-emitting member extend in the same direction and are staggered in arrangement; during a process of relative sliding of the second support and the first support, the second support has a contracted state, in which the second support is stacked on the first support. When storing the lamp, the second support is slid to the contracted state, and the second light-emitting member and the first light-emitting member are stacked in arrangement, which can shorten the overall length of the lamp, especially lamps with an elongated strip shape.

19 Claims, 16 Drawing Sheets

(56) References Cited

U.S. PATENT DOCUMENTS

| | | | | |
|---|---|---|---|---|
| 2019/0293270 | A1* | 9/2019 | Ansems | F21S 4/28 |
| 2019/0335675 | A1* | 11/2019 | Ngo | F21V 23/007 |

FOREIGN PATENT DOCUMENTS

| | | |
|---|---|---|
| CN | 104296059 | 1/2015 |
| CN | 104296061 | 1/2015 |
| CN | 209390912 | 9/2019 |
| WO | 2017156766 | 9/2017 |

* cited by examiner

A

B

D

TELESCOPIC LAMP

CROSS-REFERENCE TO RELATED APPLICATIONS

The present application claims the priority of a Chinese patent application No. 202110300554.3 filed with the Chinese Patent Office on Mar. 19, 2021, titled "a telescopic lamp", and the priority of a Chinese patent application No. 202110724118.9 filed with the Chinese Patent Office on Jun. 28, 2021, titled "a telescopic lamp"; the entire contents of which are incorporated herein by reference.

TECHNICAL FIELD

The present application relates to the technical field of lighting lamp design, and in particular to a telescopic lamp.

BACKGROUND

At present, in order to adjust the height of the lamp for lighting, the lamp is generally mounted on a telescopic pole, and the height of the lamp is adjusted through the telescopic movement of the telescopic pole. The telescopic pole can be shortened to facilitate storage when the lamp is not in use.

However, the lamp itself does not have a retractable function. For some lamps with an elongated strip shape, as the lamp is long in length, it is required to select relatively a long box to store the lamps, which may cause inconvenience for carrying.

SUMMARY

Therefore, the technical problem to be solved by the present application is how to overcome the defect in the prior art that the lamp itself cannot be contracted or extended, which causes a demand for a long space for storing the lamp and inconvenience for carrying, so as to provide a telescopic lamp.

In order to solve the above technical problems, the technical solution of the present application is as follows:

a lamp, comprising:

a lamp handle;

a first support, having a first light-emitting member disposed thereon;

a second support, extending in the same direction as the first support, slidably connected to the first support along a length direction of the first support, and having a second light-emitting member mounted thereon;

wherein, the second light-emitting member and the first light-emitting member extend in the same direction and are arranged to be non-coplanar;

during a process of relative sliding of the second support and the first support, the second support has a contracted state, in which the second support is stacked on the first support, so as to cause the second light-emitting member to be stacked on the first light-emitting member, and has an extended state, in which the second support extends outwards relative to the first support, so as to cause the second light-emitting member and the second light-emitting member to be arranged in sequence along a length direction of the first support.

Furthermore, the second support has a cavity disposed therein, which extends along a length direction of the second support, and the first support is slidably connected with an interior of the cavity of the second support; when the second support is in the contracted state, the first support is received in the cavity, and when the second support is in the extended state, the first support extends out of the cavity.

Furthermore, the second support has an elongated semi-cylindrical structure, and the second support comprises a horizontal top surface at a side surface thereof, and the second light-emitting element is mounted on the horizontal top surface of the second support.

Furthermore, the cavity of the second support has a cross-section with a semi-circular shape, and the first support has a cross-section with the same size as the cross section of the cavity of the second support.

Furthermore, the first light-emitting member is connected to the lamp handle and a receiving gap is arranged between the first light-emitting member and the first support; when the second support is in the contracted state, the second light-emitting member is arranged in the receiving gap and covered by the first light-emitting member.

Furthermore, the horizontal top surface of the second support has a first sliding groove disposed thereon, which extends along the length direction of the first support; and the first light-emitting member is provided with a first sliding block slidably connected to the first sliding groove at one side facing the first support.

Furthermore, an outer wall of the first support is provided with a guide groove recessed inwardly and extending along the length direction of the first support; and an outer wall of the second support is recessed to form a guide block matching the shape of the guide groove.

Furthermore, the second support further comprises a circular-arc side surface, and the guide block is arranged on the circular-arc side surface of the second support and has a cross section with an arc shape.

Furthermore, the first light-emitting member is connected to the first support, and when the second support is in the contracted state, the second light-emitting member is arranged over the first light-emitting member to cover the first light-emitting member.

Furthermore, a locking mechanism is arranged between the first support and the second support to lock the second support in the contracted state or the extended state.

Further, the locking mechanism comprises a lock block structure arranged on the first support, and a first lock hole and a second lock hole respectively arranged on opposite ends of the length direction of the second support; and the outer wall of the first support is provided with a mounting groove, and the lock block structure (6) comprises a first elastic member with one end thereof connected to a bottom of the mounting groove and a snap bead connected to the other end of the first elastic member, and the snap bead protrudes from the mounting groove and extends into the first lock hole or the second lock hole to maintain a locking between the second support and the first support under an action of the first elastic member.

Furthermore, a plurality of the first lock holes and the second lock holes are respectively arranged along a circumference and an axis of the second support;

a plurality of the lock block structures are also respectively arranged along a circumference and an axis of the first support; and the plurality of the lock block structures are arranged in one-to-one correspondence with the plurality of the first lock holes and the plurality of second lock holes.

Furthermore, the locking mechanism comprises a limiting slot arranged on the outer wall of the first support, and a first wedge block and a second wedge block respectively arranged on inner walls of opposite ends of the length direction of the second support and having inclined guide surfaces; wherein the first wedge block is arranged to cooperate with the limiting slot to lock the second support in the contracted state, and the second wedge block is arranged to cooperate with the limiting slot to lock the second support in the extended state.

Furthermore, a light-emitting surface of the first light-emitting element and a light-emitting surface of the second light-emitting element are located on the same side surface of the lamp.

Furthermore, the first light-emitting member and the second light-emitting member both have an elongated shape.

Furthermore, a second elastic member is arranged in the cavity of the second support, and the other end of the second elastic member is connected to the first support.

Furthermore, a circuit of the first light-emitting member is connected to a power circuit, and a triggering mechanism is arranged between the first light-emitting member and the second light-emitting member for controlling conducting or non-conducting between a circuit of the second light-emitting member and the power circuit; when the second support is in the extended state, the triggering mechanism is triggered to cause the circuit of the second light-emitting member to become conductive with the power circuit; when the second support is in the contracted state, the triggering mechanism is opened to cause the circuit of the second light-emitting to be disconnected with the power circuit.

Furthermore, the power circuit is arranged on a control circuit board, and the first light-emitting member and the second light-emitting member both are electrically connected to the control circuit board; the triggering mechanism comprises a travel switch and a travel switch trigger block, one of the travel switch and the travel switch trigger block is arranged at one end of the first light-emitting member close to the second light-emitting member, and the other is arranged at one end of the second light-emitting member close to the first light-emitting member; when the second support is in the extended state, the travel switch trigger block contacts the travel switch to control the circuit of the second light-emitting member to become conductive with the power circuit; when the second support is in a contracted state, the travel switch trigger block is not in contact with the travel switch to control the circuit of the second light-emitting member to be disconnected with the power circuit.

Furthermore, the triggering mechanism comprises a first electrical contact point arranged on the first light-emitting member and a second electrical contact point arranged on the second light-emitting member; when the second support is in the extended state, the second electrical contact point is in contact with the first electrical contact point to cause the circuit of the second light-emitting member to become conductive with the circuit of the first light-emitting member; and when the second support is in the contracted state, the second electrical contact point is out of contact with the first electrical contact point.

Furthermore, a first housing is sleeved on an outer periphery of the first support and the first light-emitting member, and a second housing is sleeved on an outer periphery of the second support and the second light-emitting member, and the second housing is slidably connected to the first housing and embedded in the first housing.

Furthermore, the lamp handle is rotatably connected to the first support around an axis, and during a process of rotating around the axis, the lamp handle has an unfolding position in which the lamp handle is arranged coaxially with the first support and a folding position in which the lamp handle is folded against an outer side wall of the first support.

Furthermore, a side surface of the lamp handle facing the first support has a first electric contact piece protruding outwardly, and a second electrical contact piece is arranged on a side surface of the first support connected with the lamp handle; when the lamp handle is in the unfolded position, the first electric contact piece is in contact with the second electric contact piece.

The technical solution of this application has the following advantages:

The telescopic lamp of the present application comprises a first support and a second support that extends in the same direction and are slidably connected. A first light-emitting member is arranged on the first support, a second light-emitting member is arranged on the second support, and the second light-emitting member and the first light-emitting member extend in the same direction and are staggered in arrangement. When the lamp is required to have a relatively long lighting length during use, the second support is slid to an extended state, and the first light-emitting member and the second light-emitting member are arranged in sequence, which can meet the length requirements of the lamp for lighting; when storing the lamp, the second support is slid to the contracted state, and the second light-emitting member and the first light-emitting member are stacked in arrangement, which can shorten the overall length of the lamp, especially for a lamp with an elongated strip shape. Correspondingly, the length of the box for storing such lamp can be shortened, and the lamp is convenient to carry.

In the telescopic lamp of the present application, a cavity is arranged inside the second support, and the first support is slidably connected with an interior of the cavity of the second support, which is beneficial for maintaining the straightness of the second support during a sliding process and improve the stability of the first support and the second support during the relative sliding process, which further facilitates the contact reliability between the electrical contact point of the second light-emitting member and the electrical contact point of the first light-emitting member.

In the telescopic lamp of the present application, a cavity is arranged in the first support, and components such as the power source of the lamp can be mounted in the mounting cavity of the first support, such that the length of the lamp handle can be shortened, which is more convenient for carrying the lamp.

In the telescopic lamp of the present application, the first light-emitting member is connected to the lamp handle and a receiving gap is arranged between the first light-emitting member and the first support. When the second support is in the contracted state, the second light-emitting member is arranged in the receiving gap and is blocked by the first light-emitting member. Since the first light-emitting member is directly connected to the lamp handle, the second support does not affect a connection wire between the first light-emitting member and the lamp handle during a contracted process. When the lamp is in the contracted state, the first light-emitting member can emit light normally and will not be blocked by the second light-emitting member. Therefore, the lamp has two different lighting lengths respectively in the contracted state and the extended state, which solves the problem of the prior art that the lighting lamp has a fixed and unadjustable length. Therefore, the lamp of the present application is more practical. In addition, compared with the technical solution that the second support is embedded in the first support, as the power source of the lamp needs to be mounted in the mounting cavity of the first support, the second support with the same length as the first support cannot be completely contracted and received in the mounting cavity of first support, which causes the overall storage length of the lamp is still long. If a short second support is used, the lighting length of the lamp can be affected.

In the telescopic lamp of the present application, a locking mechanism is arranged between the first support and the second support, and the second support can be locked in the contracted state or in the extended state, which is beneficial for maintaining the stability of the state thereof when the lamp in the extended state or the contracted state.

In the telescopic lamp of the present application, the first support and the second support are designed to adopt the snap bead with spring for limiting and locking, which is simple in structure and has high stability; and after locking, it is convenient to apply an external manual force to overcome the limiting function between the snap bead and the locking hole to facilitate the telescopic adjustment and locking of the lamp.

In the telescopic lamp of the present application, a second elastic member is arranged between the first support and the second support, which can be used to achieve an automatic extension and contraction of the lamp and the operation is more convenient.

In the telescopic lamp of the present application, the lamp handle is rotatably connected to the first support around an axis, and during a process of rotating around the axis, the lamp handle has an unfolding position in which the lamp handle is arranged coaxially with the first support and a folding position in which the lamp handle) is folded against an outer side wall of the first support. For the arrangement that the lamp handle is foldable, after the lamp handle is folded, the overall storage length of the lamp is short, and it is more convenient to carry the lamp.

BRIEF DESCRIPTION OF THE DRAWINGS

In order to more clearly illustrate the specific embodiments of the present application or the technical solutions in the prior art, the following will briefly introduce the drawings that need to be used in the specific embodiments or the description of the prior art. Obviously, the drawings in following description are the embodiments of the present application. For those of ordinary skill in the art, other drawings can be obtained based on these drawings without creative efforts.

Figure 1:
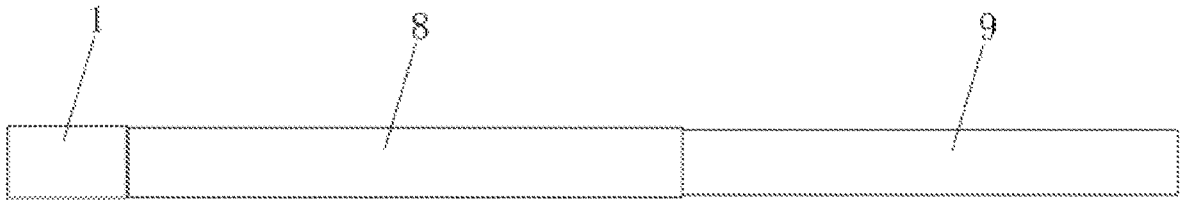
FIG. 1 is a schematic structural view of a telescopic lamp in an extended state according to embodiment 1 of the present application.
Figure 2:
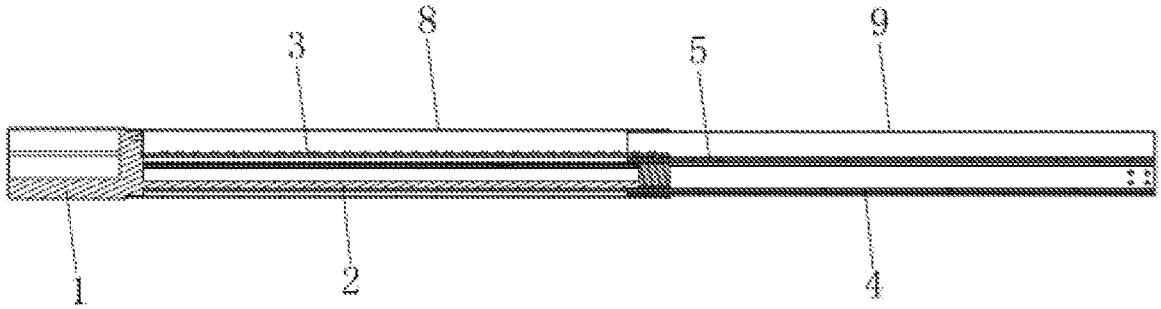
FIG. 2 is a sectional view of a telescopic lamp in an extended state according to embodiment 1 of the present application.
Figure 3:
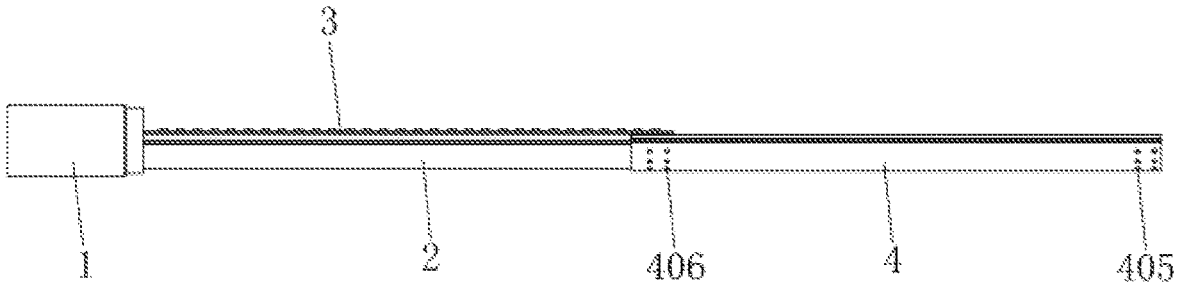
FIG. 3 is a front view of the telescopic lamp in an extended state with the first housing and the second housing not shown according to embodiment 1 of the present application.
Figure 4:
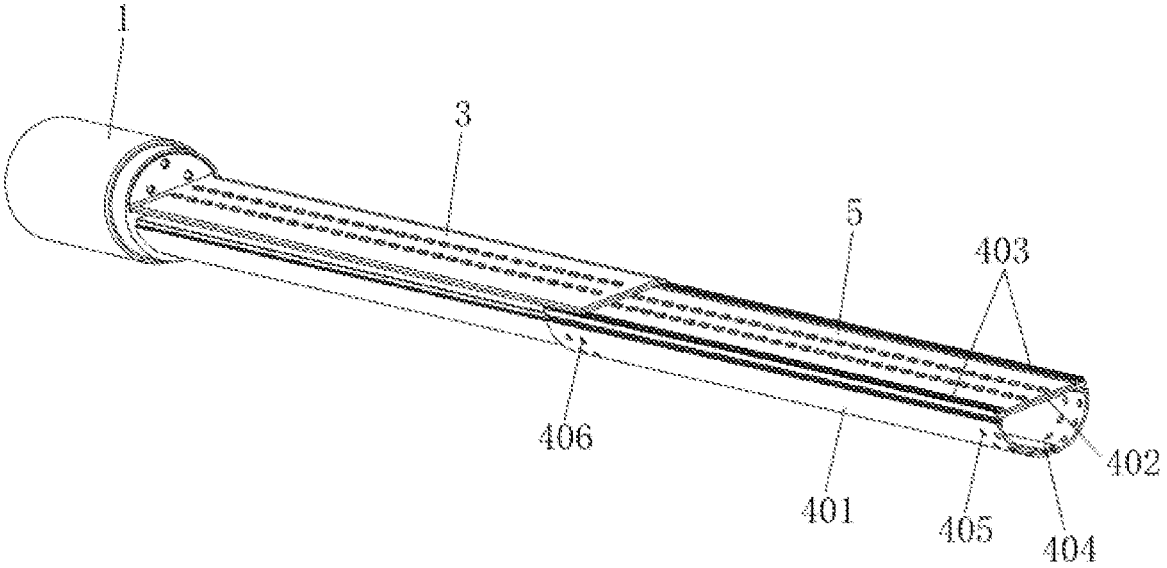
FIG. 4 is a schematic perspective structural view of a telescopic lamp in an extended state with the first housing and the second housing not shown according to embodiment 1 of the present application.
Figure 5:
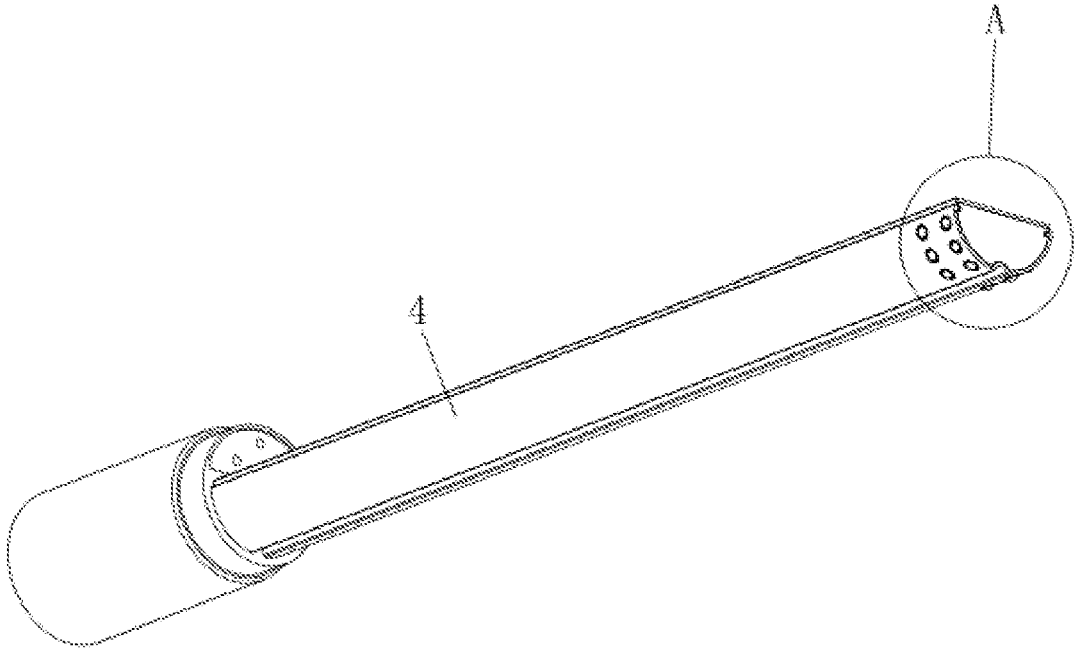
FIG. 5 is a schematic perspective structural view of a telescopic lamp in a contracted state with the first housing and the second housing not shown according to embodiment 1 of the present application.
Figure 6:
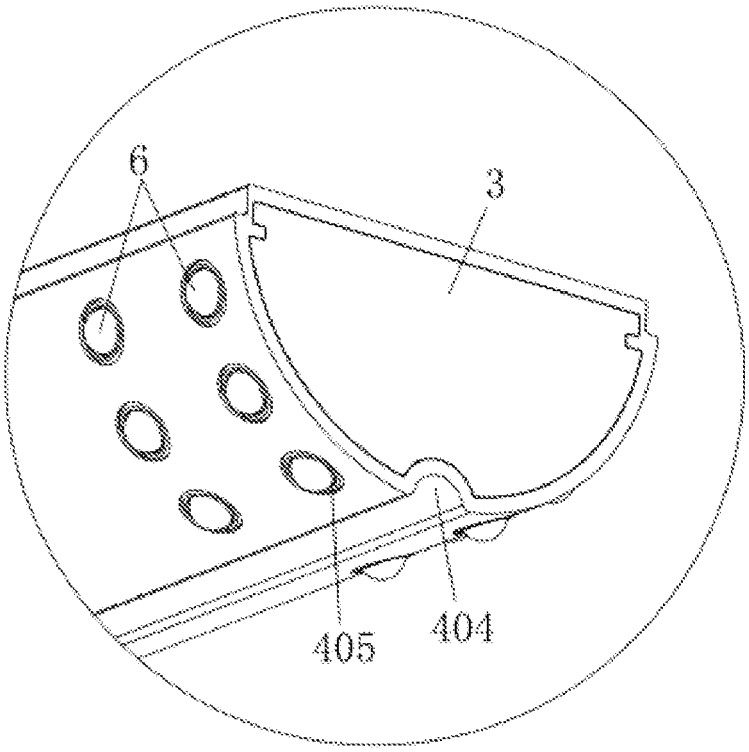
FIG. 6 is an enlarged view of part A in FIG. 5.
Figure 7:
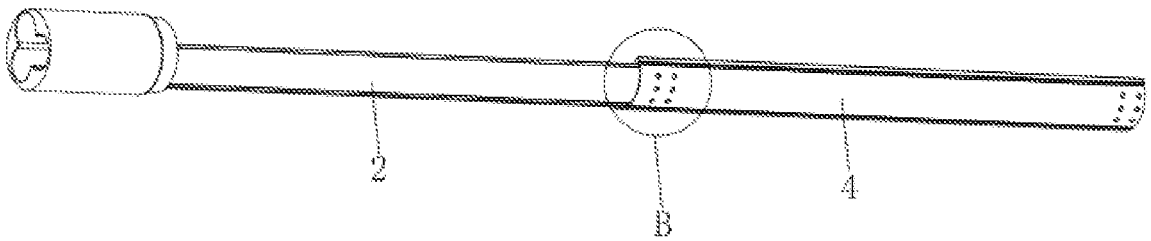
FIG. 7 is a schematic perspective structural view of a second support in an extended state with the first housing and the second housing not shown according to embodiment 1 of the present application.
Figure 8:
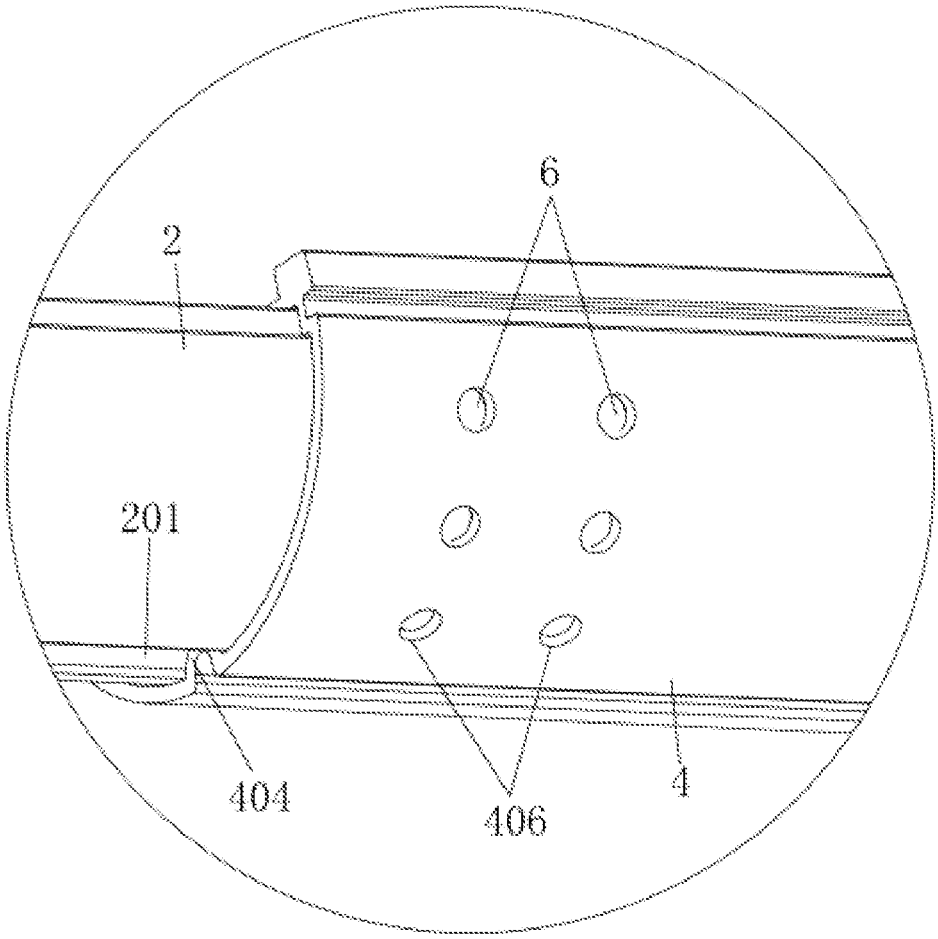
FIG. 8 is an enlarged view of part B in FIG. 7.
Figure 9:
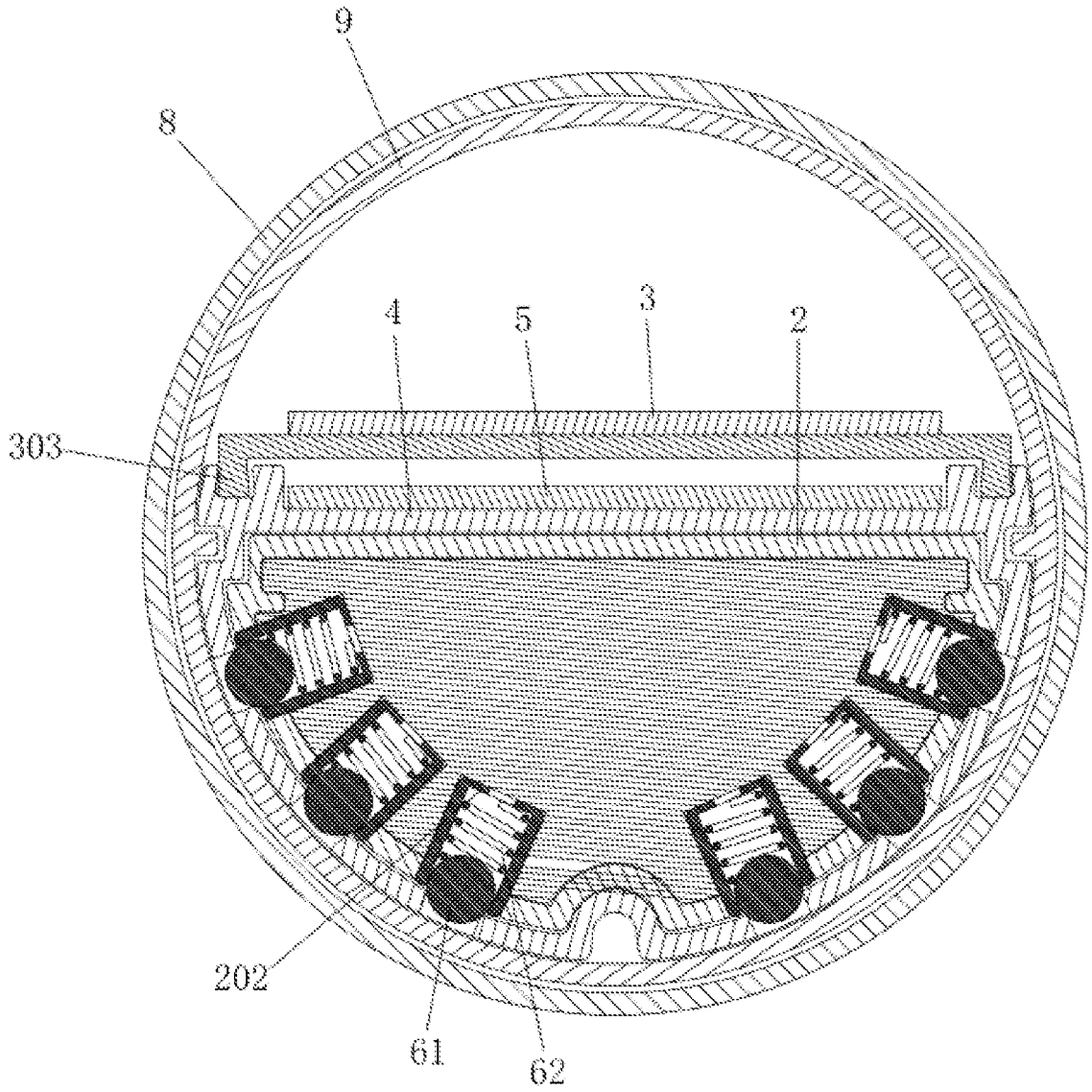
FIG. 9 is a schematic sectional view of a telescopic lamp according to embodiment 1 of the present application.
Figure 10:
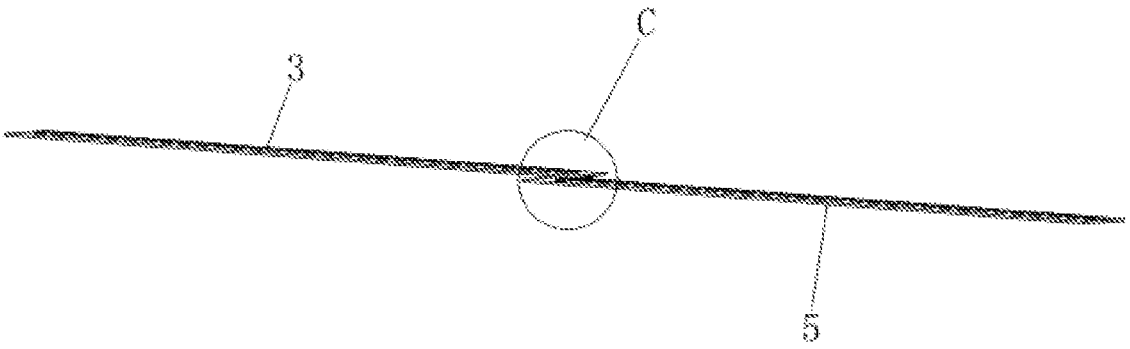
FIG. 10 is a schematic view of the state of the first light-emitting member and the second light-emitting member when the telescopic lamp is in an extended state according to embodiment 1 of the present application.
Figure 11:
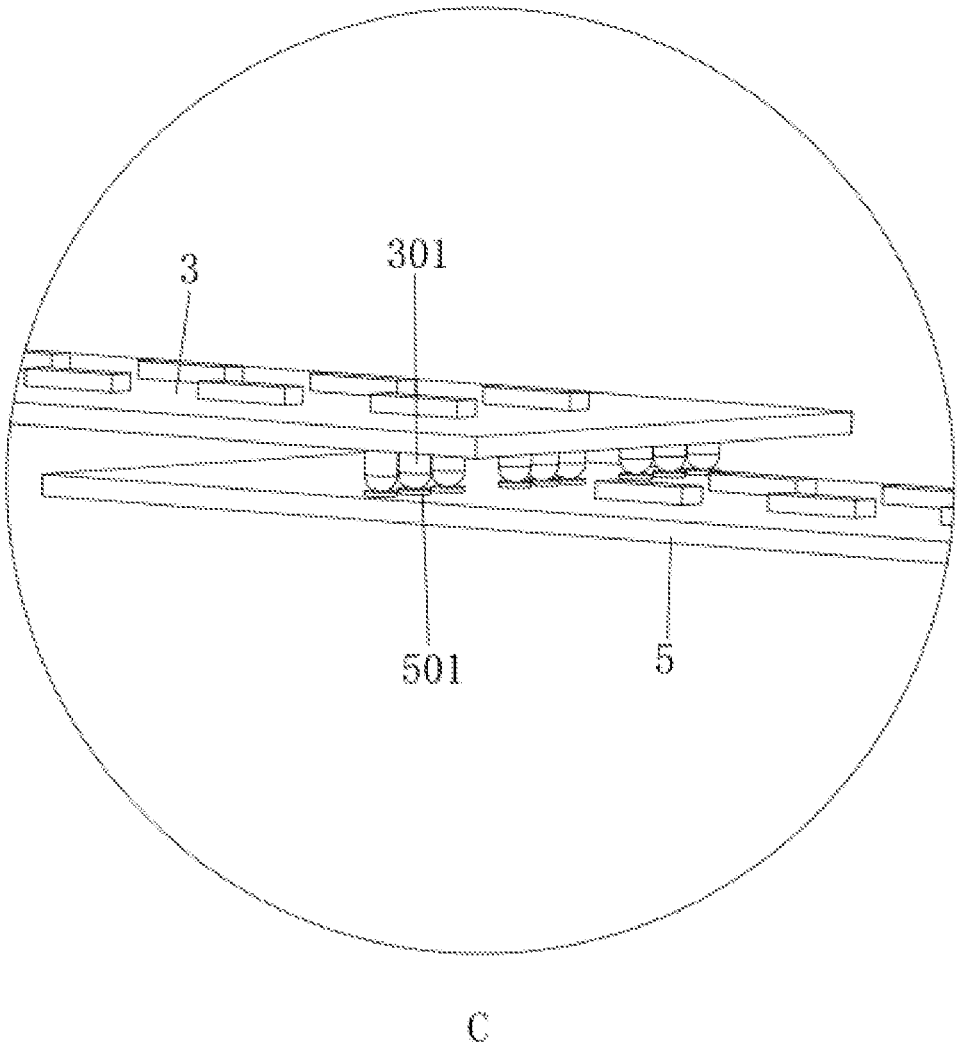
FIG. 11 is an enlarged view of part C in FIG. 10.
Figure 12:
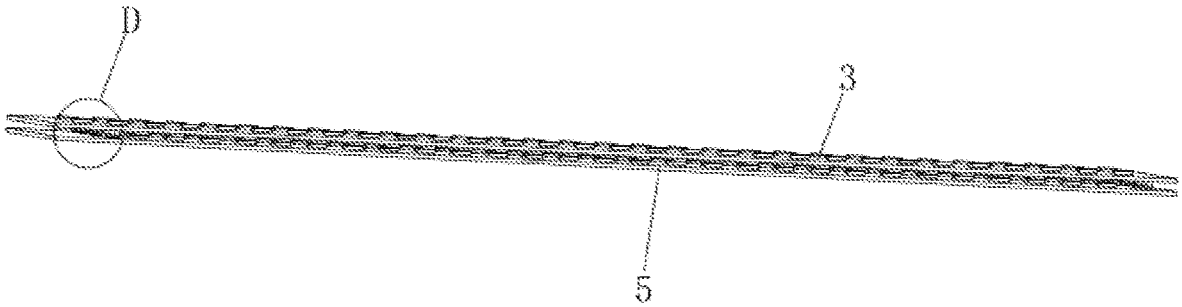
FIG. 12 is a schematic view of a stacked structure of the first light-emitting member and the second light-emitting member when a telescopic lamp is in a contracted state according to embodiment 1 of the present application.
Figure 13:
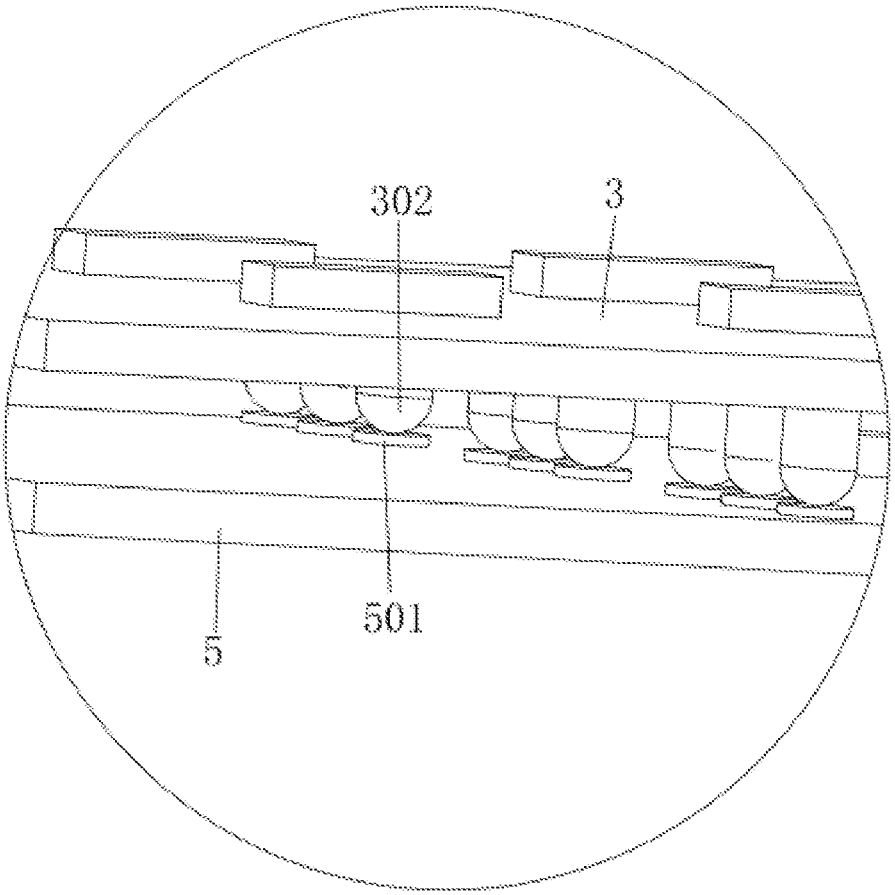
FIG. 13 is an enlarged view of part D in FIG. 12.
Figure 14:
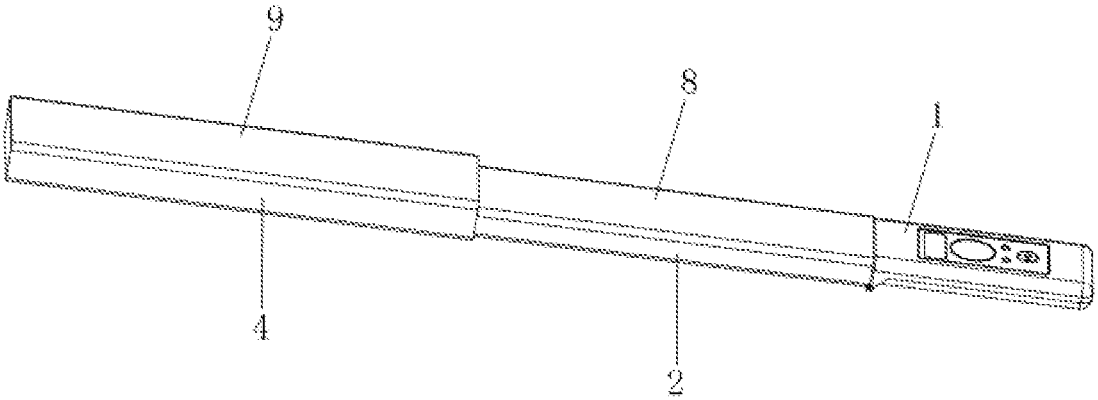
FIG. 14 is a schematic structural view of a telescopic lamp in an extended state according to embodiment 2 of the present application.
Figure 15:
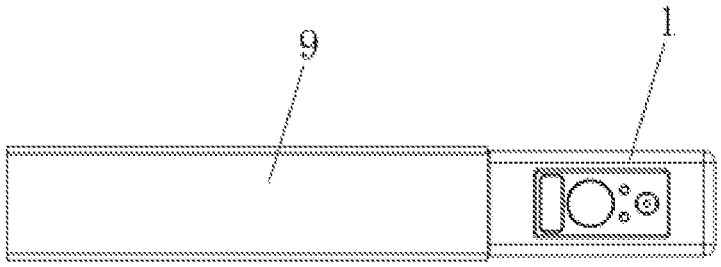
FIG. 15 is a schematic structural view of a telescopic lamp in a contracted state according to Embodiment 2 of the present application.
Figure 16:
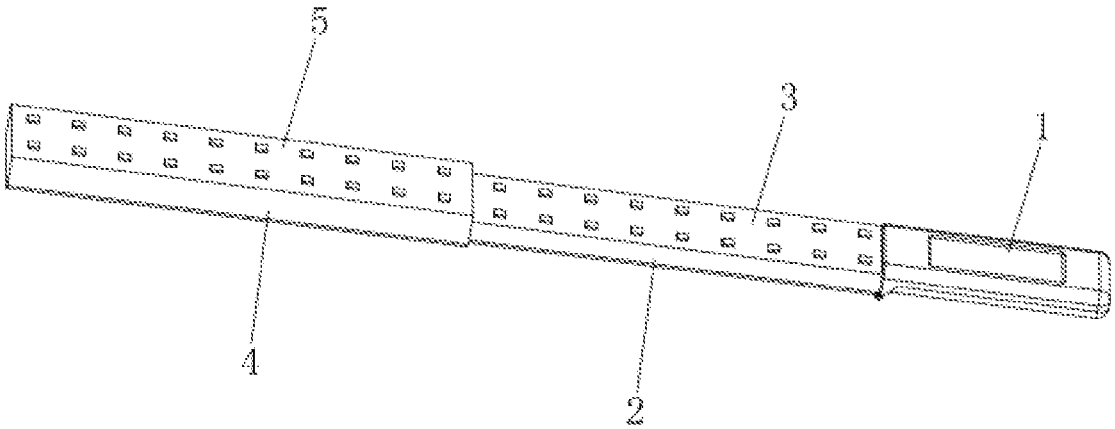
FIG. 16 is a schematic perspective structural view of a telescopic lamp in an extended state with the first housing and the second housing not shown according to embodiment 2 of the present application.
Figure 17:
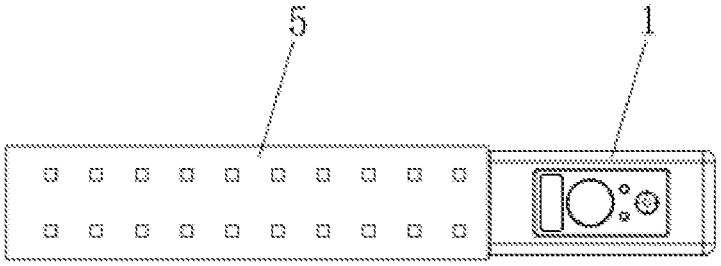
FIG. 17 is a top view of a telescopic lamp in a contracted state with the first housing and the second housing not shown according to embodiment 2 of the present application.
Figure 18:
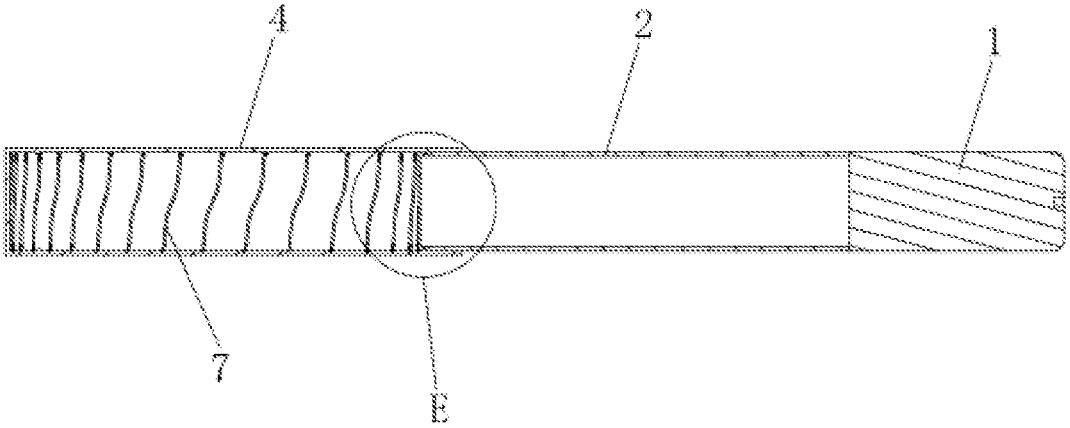
FIG. 18 is a sectional view of a telescopic lamp in an extended state according to embodiment 2 of the present application.
Figure 19:
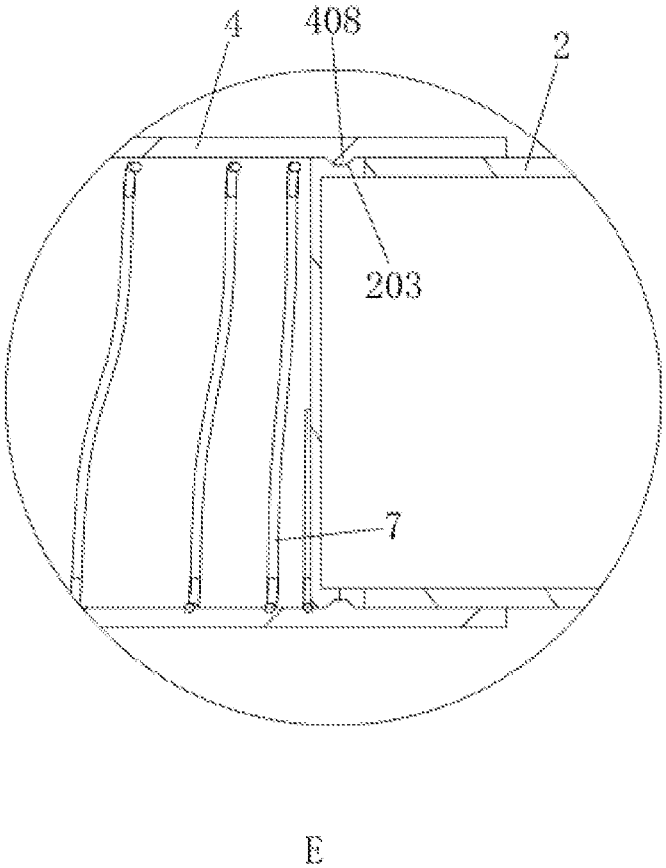
FIG. 19 is an enlarged view of part E in FIG. 18.
Figure 20:
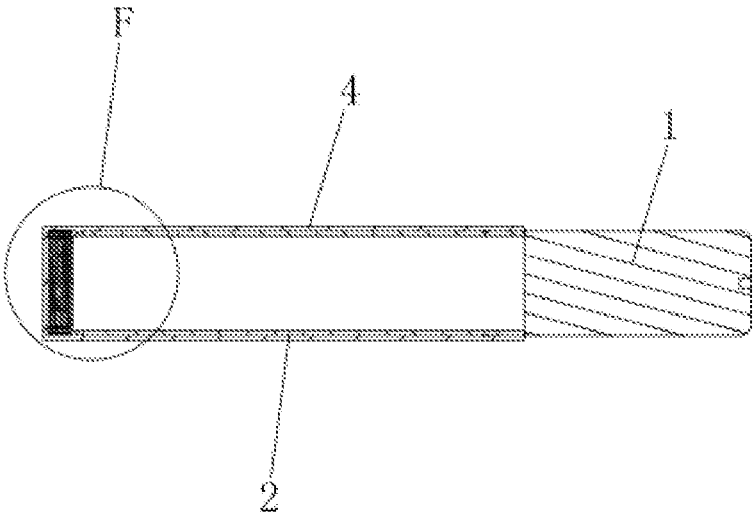
FIG. 20 is a sectional view of a telescopic lamp in a contracted state according to embodiment 2 of the present application.
Figure 21:
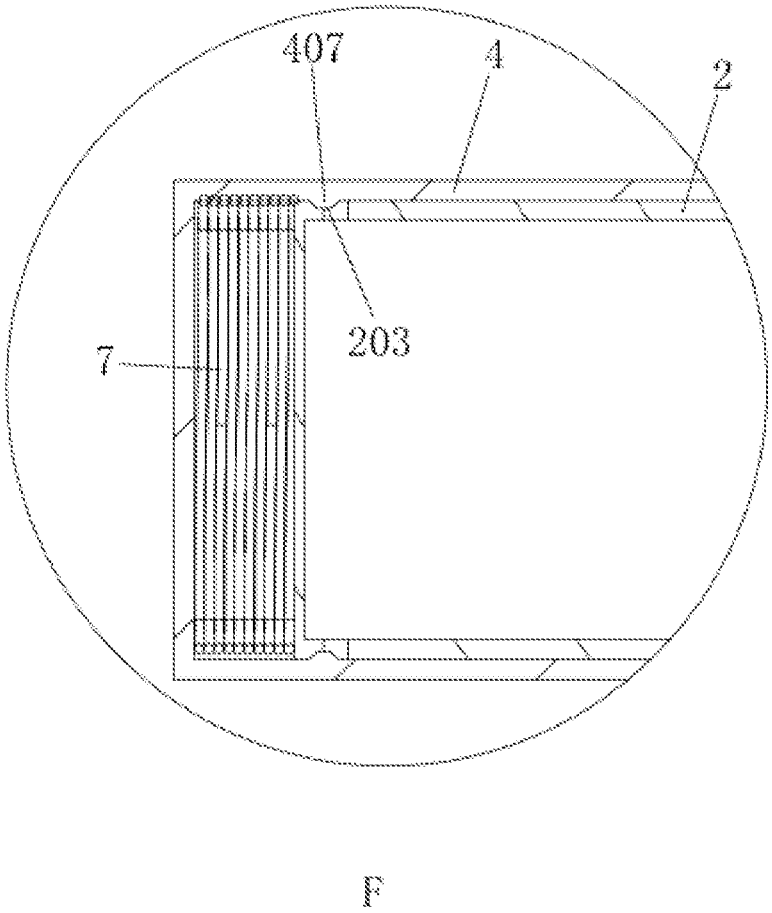
FIG. 21 is an enlarged view of part F in FIG. 20.
Figure 22:
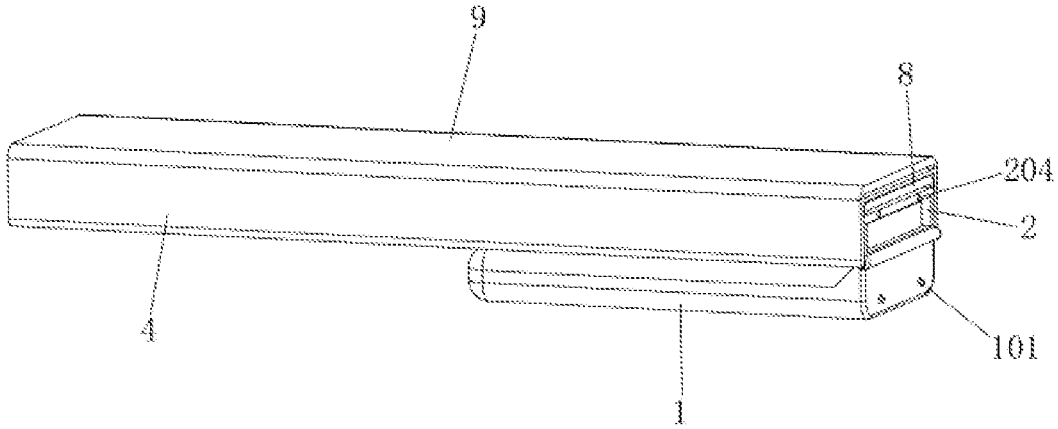
FIG. 22 is a perspective structural sectional view of a telescopic lamp in a contracted state with the lamp handle in a folded state according to embodiment 2 of the present application.
Figure 23:
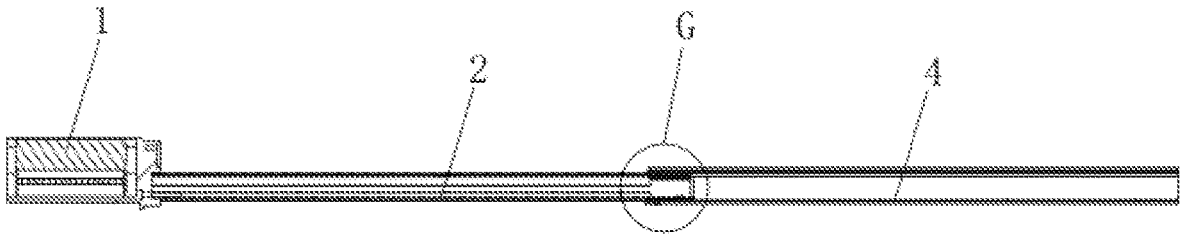
FIG. 23 is a schematic sectional view of a telescopic lamp in an extended state with the first housing and the second housing not shown according to embodiment 3 of the present application.
Figure 24:
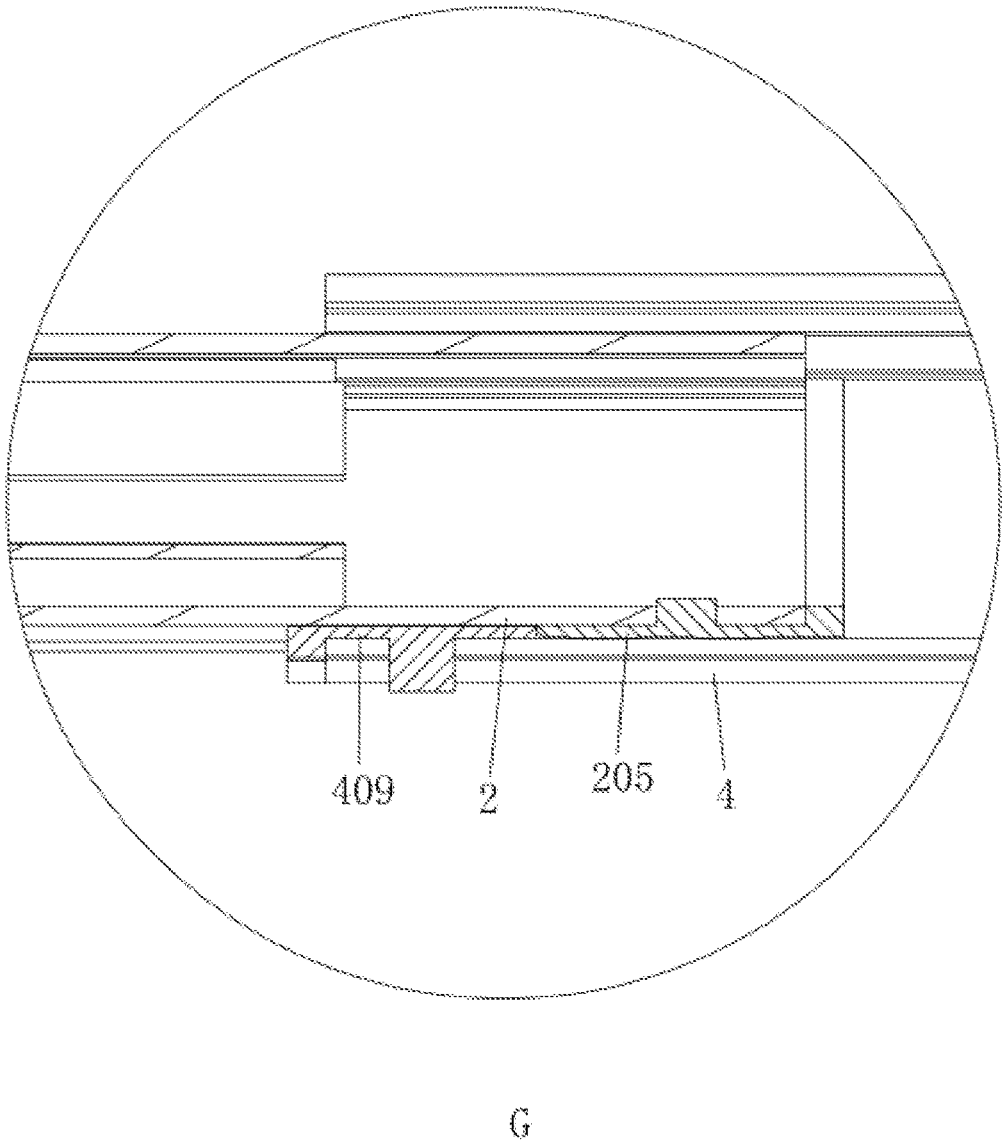
FIG. 24 is an enlarged view of part Gin FIG. 23.
Figure 25:
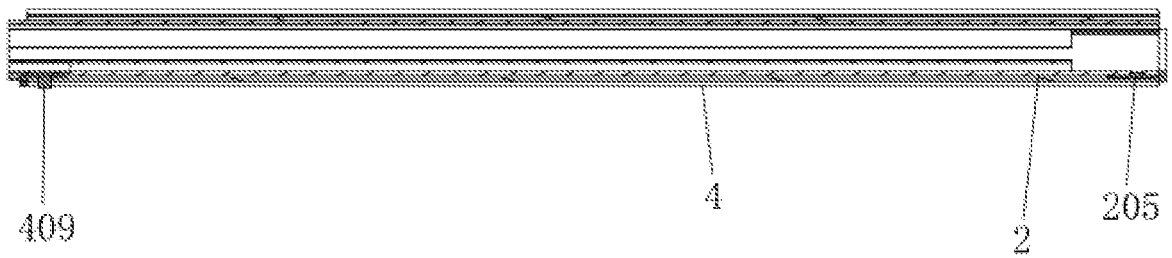
FIG. 25 is a schematic sectional view of a telescopic lamp in a contracted state with the first housing, the second housing, and the lamp handle not shown according to embodiment 3 of the present application.
Figure 26:
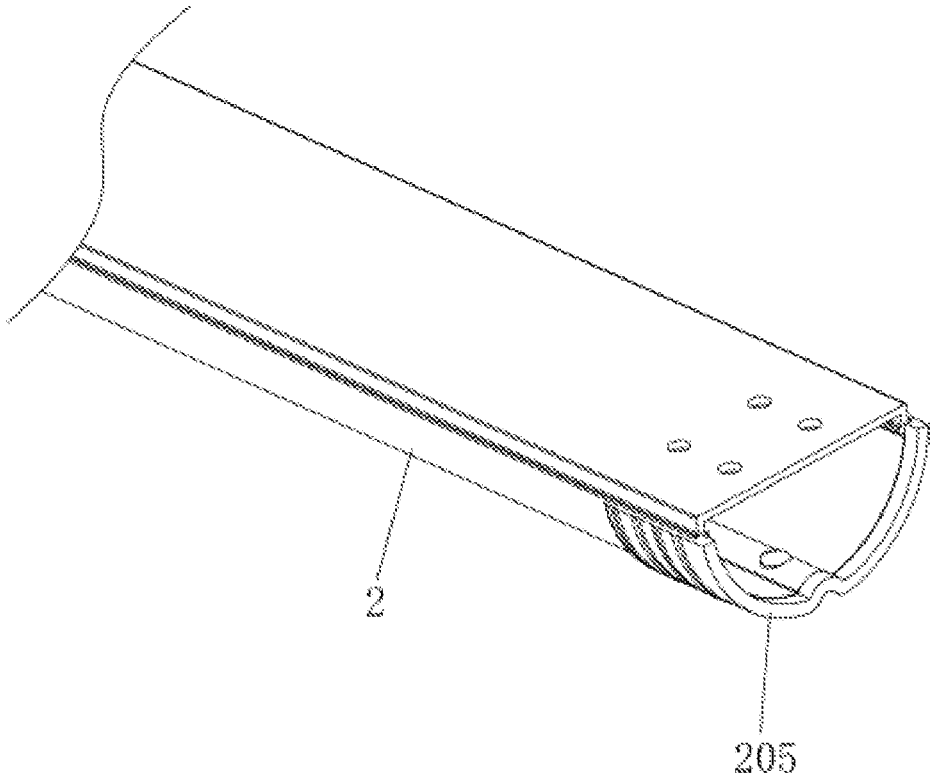
FIG. 26 is a schematic view showing the connection relationship between an anti-slip member and a first support according to embodiment 3 of the present application. FIGURE
Figure 27:
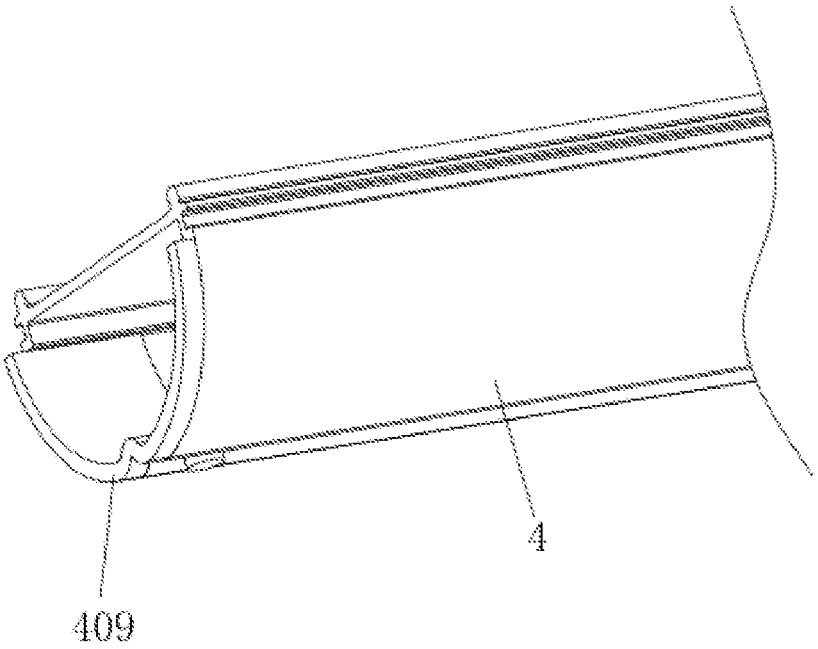
FIG. 27 is a schematic view showing the connection relationship between a sleeve and a second support according to embodiment 3 of the present application.
Figure 28:
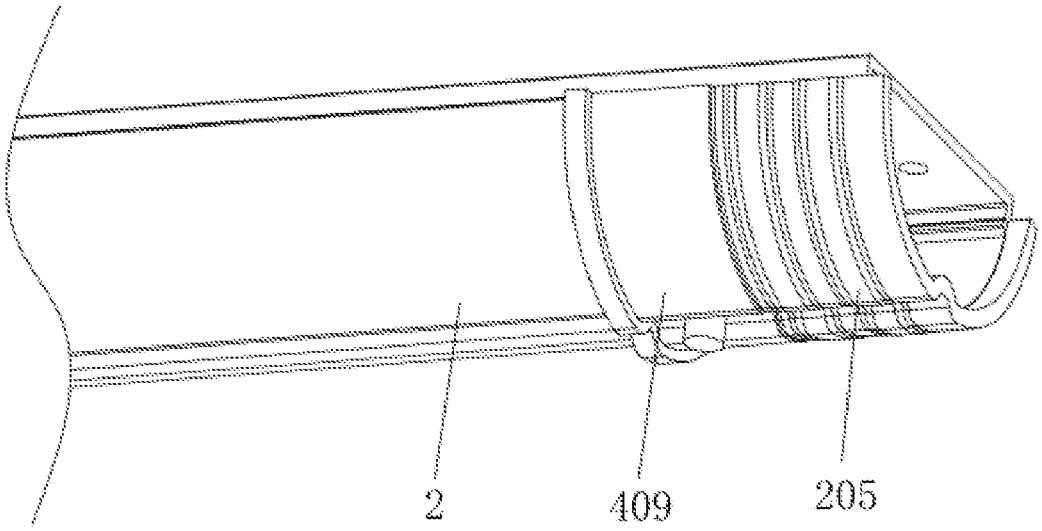
FIG. 28 is a schematic view showing the connection relationship between an anti-slip member, a sleeve and a first support according to embodiment 3 of the present application.

REFERENCE NUMERAL lamp handle; 101, first electric contact piece; 2. first support; 201, guide groove; 202, mounting groove; 203, limiting slot; 204, second electric contact piece; 205. anti-slip member; 3. first light-emitting member; 301, first electrical contact point; 302, third contact point; 303, first sliding block; 4. second support; 5. second light-emitting member; 501, Second electrical contact point; 401, circular-arc side surface; 402, horizontal top surface; 403, first sliding groove; 404, guide block; 405, first locking hole; 406, second locking hole; 407, first wedge block; 408, second wedge block; 409, sleeve; 6, locking block structure; 61, first elastic member; 62, snap bead; 7, second elastic member; 8, first housing; 9, second housing; 10. control circuit board; 11. wire; 12. travel switch; 13. travel switch trigger block.

DETAILED DESCRIPTION

The technical solutions of the present application will be described clearly and completely in combination with the drawings. It is obvious that the described embodiments only represent part, but not all of the embodiments of the present application. All the other embodiments made by a person skilled in the art based on the embodiments of the present application without paying any creative intellectual efforts fall within the scope of the present application.

In the description of the present application, it should be noted that the orientation or positional relationship indicated by those terms comprising "center", "upper", "lower", "left", "right", "vertical", "horizontal", "inside", "outside" are based on the orientation or positional relationship shown in the drawings, and are merely for the convenience of describing the present application and simplifying description, and are not intend to indicate or imply that the apparatus or components referred to have a specific orientation and to be constructed and operated in a specific orientation, therefore, these terms are not to be construed as limiting the application. Moreover, the terms "first," "second," and "third" are only for descriptive purposes and are not to be construed as indicating or implying relative importance.

In the description of the present application, it should be noted that the terms "mount", "connect", and "couple" should be understood broadly, for example, a connection may be a fixed connection or a removable connection or an integral connection; a mechanical connection or an electrical connection; a direct connection or an indirect connection through an intermediate medium, or an internal communication between the two elements. The specific meanings of the above terms in the present application can be understood by a person skilled in the art according to specific situation.

Further, the technical features involved in the different embodiments of the present application described below may be combined with each other as long as they do not constitute a conflict with each other.

Embodiment 1

A telescopic lamp as shown in FIGS. 1-13 comprises a lamp handle 1, a first support 2, a second support 4, a first light-emitting member 3, a second light-emitting member 5, a first housing 8 and a second housing 9. Among the above components, the first support 2, the second support 4, the first light-emitting member 3, the second light-emitting member 5, the first housing 8 and the second housing 9 all have an elongated strip shape and extend in the same direction.

In embodiment 1, one end of each of the first support 2, the first light-emitting member 3 and the first housing 8 is fixedly connected to one end surface of the lamp handle 1, and a receiving gap is arranged between the first light-emitting member 3 and the first support 2. The first housing 8 is sleeved on an outer periphery of the first support 2 and the first light-emitting member 3. The second support 4 is slidably connected to the first support 2 along a length direction of the first support 2, the second light-emitting member 5 is mounted on the second support 4 and is arranged in a staggered arrangement with the first light-emitting member 3, and the second housing 9 is sleeved on the outer periphery of the second support 4 and the second light-emitting member 5, the second housing 9 is slidably connected to and embedded in the first housing 8.

During a process of relative sliding of the second support 4 and the first support 2, the second support 4 has a contracted state in which the second support 4 is stacked on the first support 2 such that the second light-emitting member 5 is stacked on the first light-emitting member 3, and an extended state, in which the second support 4 extends outwards relative to the first support 2 such that the second light-emitting member 5 and the second light-emitting member 5 are arranged in sequence along a length direction of the first support 2. When the second support 4 is in the contracted state, the second light-emitting member 5 is arranged in the receiving gap and is blocked by the first light-emitting member 3.

In telescopic lamp with the above structure, since the second support 4 and the first support 2 are extended and slidably connected with an interior of the same direction, and the second light-emitting member 5 and the first light-emitting member 3 are arranged in a staggered manner. When the lamp is required to have an elongated length for lighting during use, the second support 4 can be slid to an extended state, and the first light-emitting member 3 and the second light-emitting member 4 are arranged in sequence, which can meet the requirements for the length of the lamp for lighting; when storing the lamp, the second support is slid to the contracted state, and the second light-emitting member 3 and the first light-emitting member 5 are stacked in arrangement, which can shorten the overall length of the lamp, especially for the lamp with an elongated strip shape. Correspondingly, the length of the box for storing such lamp can be shortened, and the lamp is convenient to carry.

In embodiment 1, a circuit on the first light-emitting member 3 is connected to a power circuit, and a triggering mechanism is arranged between the first light-emitting member 3 and the second light-emitting member 5 for controlling conducting or non-conducting between a circuit on the second light-emitting member and the power circuit; when the second support 4 is in the extended state, the triggering mechanism is triggered to cause the circuit on the second light-emitting member 5 to become conductive with the power circuit; when the second support 4 is in the contracted state, the triggering mechanism is turned off to cause the circuit on the second light-emitting member 5 to be disconnected with the power circuit. Specifically, the triggering mechanism comprises a first electrical contact point 301 arranged on the first light-emitting member 3 and a second electrical contact point 501 arranged on the second light-emitting member 5; when the second support 4 is in an extended state, the second electrical contact point 501 is in contact with the first electrical contact point 301 to cause the circuit on the second light-emitting member 5 to become conductive with the circuit on the first light-emitting member 3. After the lamp is turned on, the first light-emitting member 3 and the second light-emitting member 5 can be powered on to emit light at the same time. When the second support 4 is in the contracted state, the second electrical contact point 501 is out of contact with the first electrical contact point 301. After the lamp is turned on, only the first light-emitting member 3 is powered on to emit light, such that the lamp can also be powered on to emit light in the contracted state. Therefore, the lamp has two different lighting lengths respectively in the contracted state and the extended state, which solves the problem of the prior art that the lighting lamp has a fixed and unadjustable length, therefore, the lamp of the present application is more practical. In addition, the first light-emitting member 3 has a third contact point 302 disposed thereon. When the second support 4 is in the contracted state, the second electrical contact point 501 is in contact with the third contact point 302, while at this time, the circuit on the second light-emitting member 5 is not conductive to the circuit on the first light-emitting member 3, and the third contact point 302 only functions to protect the second electrical contact point 501.

In embodiment 1, the second support 4 has a cavity disposed therein that extends along a length extension direction of the second support 4, and the first support 2 is slidably connected with an interior of the cavity of the second support 4; when the second support 4 is in a contracted state, the first support 2 is completely received in the cavity of the second support 4; when the second support 4 is in an extended state, the first support 2 protrudes from the cavity. The structure in which the first support 2 is slidably connected with an interior of the cavity of the second support 4 is beneficial for maintaining the straightness of the second support 4 during the sliding process, and improve the stability during the relative sliding of the first support 2 and the second support 4, which further facilitates the contact reliability between the electrical contact point on the second light-emitting member 5 and the electrical contact point on the first light-emitting member 3.

In Embodiment 1, the second support 4 has an elongated cylindrical structure with a semi-circular cross section, and the cavity of the second support 4 also has a semicircular cross section; the first support 2 has an elongated cylindrical structure with a semi-circular cross section, and the cross section of the first support 2 has the same size as the cross section of the cavity of the second support 4 to facilitate the sliding fit of the first support 2 and the second support 4. In other alternative embodiments, the cavity of the second support 4 can also have a cross section with a circular or polygonal shape. Accordingly, the shape and size of the cross-section of the first support 2 remains the same as the cross-section of the cavity of the second support 4. The inside of the first support 2 is also provided with an mounting cavity, which can provide installation space for components such as the power source of the lamp, thereby reducing the requirement for the length of the lamp handle 1, which is beneficial for further shortening the overall storage length of the lamp.

In embodiment 1, since the first support 2 is closer to the lamp handle 1 than the second support 4, in order to facilitate the layout of the internal circuit on the lamp, the power source of the lamp can only be suitable to be mounted in the mounting cavity of the first support 2 and part of the internal mounting space will be occupied. In the technical solution in which the second support 4 is embedded in the first support 2, the second support 4 with the same length as the first support 2 cannot be completely received into the mounting cavity of the first support 2, which causes the overall storage length of the lamp is still long. If a short second support 4 is used, the lighting length of the lamp will be affected.

In embodiment 1, a side surface of the second support 4 comprises a circular arc side surface 401 and a horizontal top surface 402. The horizontal top surface 402 of the second support 4 has a groove disposed thereon for mounting the second light-emitting member 5. an upper surface of the second light-emitting member 5 is not higher than an opening at the top of the groove. The horizontal top surface 402 of the second support 4 is further provided with first sliding grooves 403 located on both sides of the second light-emitting member 5. The first sliding groove 403 extend in the same direction as the length extending direction of the first light-emitting member 3. A first sliding block 303 slidably connected to the first sliding groove 403 is arranged on a side surface of the first light-emitting member 3 facing the first support 2. When the second support 4 is in the extended state, the first light-emitting member 3 is arranged right over the second light-emitting member 5, and the second light-emitting member 5 is blocked by the first light-emitting member 3. Since the first light-emitting member 3 is directly connected to the lamp handle 1, connecting wires between the first light-emitting member 3 and the lamp handle 1 will not affected during the contraction process of the second support 4. When the lamp is in the contracted state, the first light-emitting member 3 can emit light normally and will not be blocked by the second light-emitting member 5, therefore, the lighting length of the lamp can be adjusted, and the lamp can be more practical.

In embodiment 1, the outer wall of the first support 2 is provided with a guide groove 201 recessed inwardly and extending in the same direction as the length extending direction of the first support 2, and an outer wall of the second support 4 is recessed to form a guide block 404 matching the shape of the guide groove 201. The guide groove 201 and the guide block 404 both have cross sections with an arc shape. Through the guiding action between the guiding block 404 and the guiding groove 201, the relative sliding between the first support 2 and the second support 4 along the length extending direction thereof can be better maintained.

In embodiment 1, a locking mechanism for locking the second support 4 in the contracted state or in the extended state is also arranged between the first support 2 and the second support 4. The locking mechanism can be used to lock the second support 4 in the contracted state or in the extended state, which is beneficial for maintaining the stability of the state of the lamp in the extended or contracted state.

Specifically, the locking mechanism comprises a locking block structure 6 arranged on the first support 2, and a first locking hole 405 and a second locking hole 406 respectively arranged on opposite ends of the length direction of the second support 4. The outer peripheral wall of the first support 2 has a mounting groove 202 disposed thereon, and the locking block structure 6 comprises a first elastic member 61 with one end thereof connected to the bottom of the mounting groove 202 and a snap bead 62 connected to the other end of the first elastic member 61, and the snap bead 62 protrudes from the mounting groove 202 and extends into the first lock hole 405 or the second lock hole 406 to maintain the locking between the second support 4 and the first support 2 under an action of the first elastic member 61.

Specifically, the first elastic member 61 is a spring; a plurality of mounting grooves 202 are arranged at even intervals along the a circumference of the outer wall of the first support 2, and a spring and a snap ball 62 are mounted in each mounting groove 202. A plurality of first locking holes 405 and second locking holes 406 are arranged along the circumference and the axis of the second support 4, and a plurality of the locking block structure 6 is also arranged along the circumference and the axis of the first support 2. The plurality of the lock block structures 6 are arranged in one-to-one correspondence with the plurality of the first lock holes 405 and the plurality of second lock holes 406.

In the telescopic lamp of the present application, the first support and the second support are designed to adopt snap bead with spring for limiting and locking, which is simple in structure and has high stability; and after locking, it is convenient to apply an external manual force to overcome the limiting function between the snap bead and the locking hole to facilitate the telescopic adjustment and locking of the lamp.

In embodiment 1, both the first housing 8 and the second housing 9 are made of light-transmitting materials to protect the first light-emitting member 3 and the second light-emitting member 5. The first light-emitting member 3 and the second light-emitting member 5 both comprise lamp panels with a strip shape, and a plurality of LED lamp snap bead arranged at intervals on the lamp panel along the length extension direction of the lamp panel. Specifically, both the first housing 8 and the second housing 9 have cylindrical structures.

In embodiment 1, the first light-emitting member 3 and the second light-emitting member 5 both have an elongated strip shape, and the light-emitting surface of the first light-emitting member 3 and the light-emitting surface of the second light-emitting member 5 are arranged on the same side surface of the lamp.

Embodiment 2

The telescopic lamp as shown in FIGS. 14-22 differ from the figures in embodiment 1 in that the first light-emitting member 3 is fixedly connected to the first support 2, and there is no receiving gap arranged between the first light-emitting member 3 and the first support 2. When the second support 4 is in a contracted state, the second light-emitting member 5 is arranged above the first light-emitting member 3 to block it. When the second support 4 is in an extended state, the electrical contact point under the second light-emitting member 5 is in contact with the electrical contact point on the first light-emitting member 3. After the lamp is turned on, the first light-emitting member 3 and the second light-emitting member 5 can be simultaneously power on and emit light.

In embodiment 2, the first support 2, the second support 4, the first housing 8 and the second housing 9 all have a square cylindrical structure. A second elastic member 7 is connected with an interior of the cavity of the second support 4, and the other end of the second elastic member 7 is connected to the first support 2. In particular, the second elastic member 7 is a spring, and the spring is arranged between the first support 2 and the second support 4, which can be used to achieve the automatic expansion and contraction of the lamp, and the operation is more convenient.

In embodiment 1, the lamp handle 1 has a control switch disposed thereon for controlling the extension/contraction and starting of the lamp.

In embodiment 1, the locking mechanism comprises a limiting slot 203 arranged on the outer wall of the first support 2, and a first wedge block 407 and a second wedge block 408 respectively arranged on inner walls of opposite ends of the length direction of the second support 4. The limiting slot 203, the first wedge block 407 and the second wedge block 408 both have inclined guide surfaces; and the first wedge block 407 cooperates with the limiting slot 203 to lock the second support 4 in the contracted state, and the second wedge block 408 cooperates with the limiting slot 203 to lock the second support 4 in the extended state.

In embodiment 2, the lamp handle 1 is rotatably connected to the first support 2 around an axis, and during a process of rotating around the axis, the lamp handle 1 has an unfolding position in which the lamp handle 1 is arranged coaxially with the first support 2 and a folding position in which the lamp handle 1 is folded against an outer side wall of the first support 2. With such a folded structure, the lamp handle 1 has a short overall storage length after the lamp handle 1 is folded, which is more convenient to carry.

In Embodiment 2, a side surface of the lamp handle 1 facing the first support 2 has a first electric contact piece 102 protruding outwardly, and a second electrical contact piece 204 is arranged on a side surface of the first support 2 connected with the lamp handle 1; when the lamp handle 1 is in the unfolded position, the first electric contact piece 101 is in contact with the second electric contact piece 204. Such a setting is adapted to control the conducting and non-conducting of the circuit on the lamp handle 1 and the circuit on the first support 2, thereby controlling the turning on and turning off of the lamp.

Embodiment 3

The telescopic lamp as shown in FIGS. 23-28 differs from the figures in embodiment 1 in that the locking mechanism in embodiment 3 has different specific structure. There is a sliding gap is arranged between the outer peripheral wall of the first support 2 and the inner peripheral wall of the second support 4. The locking mechanism comprises a anti-slip member 205 fixedly connected to the outer side wall of an end of the first support 2 away from the lamp handle 1, and a sleeve 409 fixedly connected to the inner wall of an end of the second support 4 near the lamp handle 1. The anti-slip member 205 and the sleeve 409 are used to increase the sliding damping between the first support 2 and the second support 4. When the second support 4 is in the extended state, the anti-slip member 205 and the sleeve 409 are limited to abut against with each other to avoid separation of the second support 4 from the first support 2.

Specifically, the shape of the anti-slip member 205 matches the shape of the first support 2, and the outer wall of the anti-slip member 205 has a plurality of convex ribs disposed thereon and protruding outward, and the plurality of convex ribs are spaced at even intervals. A limiting post is arranged on the sleeve 409, a limiting hole is arranged on the second support 4, and the limiting post extends into the limiting hole such that the sleeve 409 is fixedly mounted on the second support 4. Similarly, A limiting post is arranged on the anti-slip member 205, a limiting hole is also arranged on the first support 2, and the limit post extends into the limiting hole such that the anti-slip member 205 is fixedly mounted on the first support 2.

Embodiment 4

Figure 29:
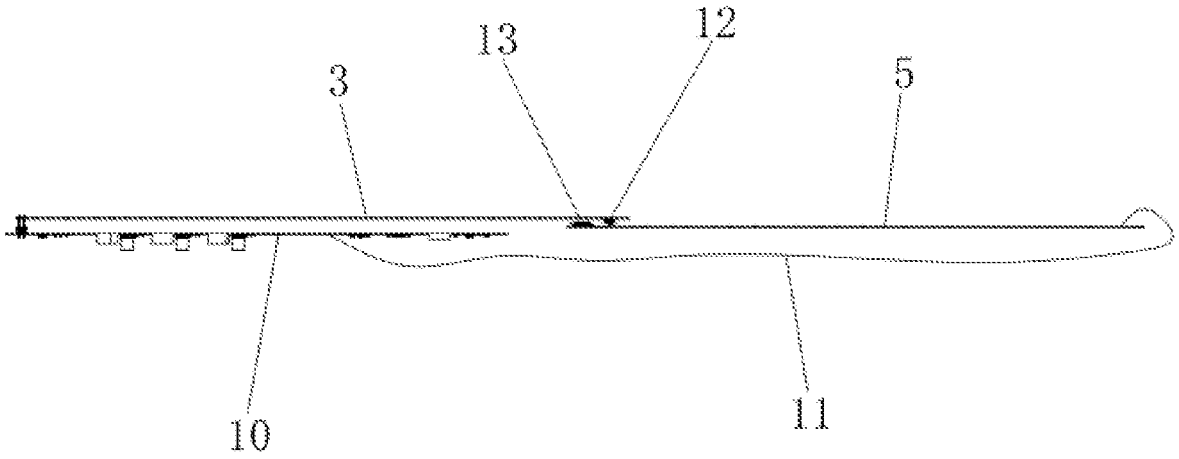
FIG. 29 is a schematic view showing a mounting structure of a triggering mechanism on the first light-emitting member and the second light-emitting member, with the triggering mechanism in an untriggered state according to embodiment 4 of the present application.
Figure 30:
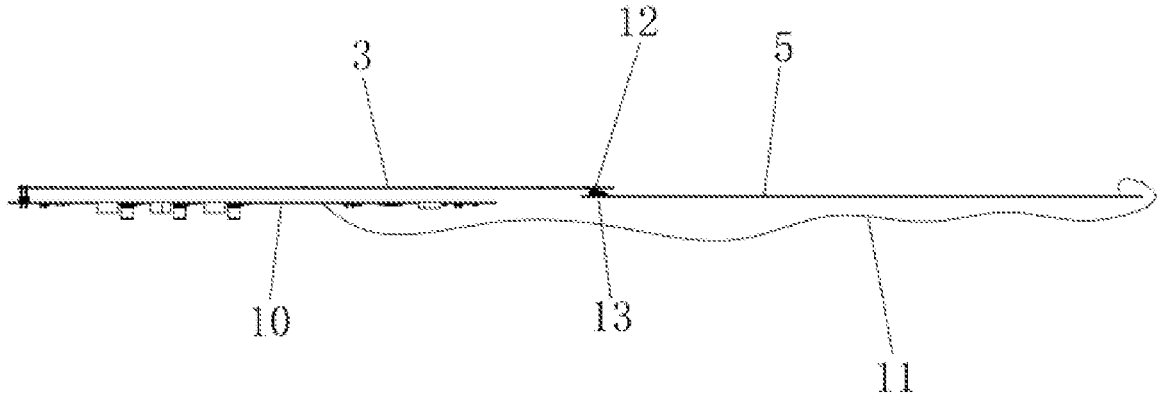
FIG. 30 is a schematic view showing a mounting structure of the triggering mechanism on the first light-emitting member and the second light-emitting member with the triggering mechanism in a trigger state according to embodiment 4 of the present application.

The telescopic lamp as shown in FIGS. 29-30 differs from the figures in embodiment 1 in that triggering mechanism has different structure. The first support 2 has a control circuit board 10 disposed therein, and the power circuit for supplying power to the first light-emitting member 3 and the second light-emitting member 5 is arranged on the control circuit board 10, and the first light-emitting member 3 and the second light-emitting member 5 are electrically connected to the control circuit board 10. Specifically, the circuit on the first light-emitting member 3 is electrically connected to the power circuit on the control circuit board 10 through an electrical connector, and the circuit on the second light-emitting member 5 is electrically connected to the power circuit on the control circuit board 11 through a wire 11. In an alternative embodiment, the circuit on the first light-emitting member 3 can also be electrically connected to the power circuit on the control circuit board 10 through a wire, and the control circuit board 10 can also be arranged in the lamp handle 1.

In embodiment 1, the triggering mechanism comprises a travel switch 12 and a travel switch trigger block 13. The travel switch 12 is mounted at one end of the first light-emitting member 3 close to the second light-emitting member 5 and is arranged to face the second light-emitting member 5; the travel switch trigger block 13 is mounted at one end of the second light-emitting member 5 close to the first light-emitting member 3 and is arranged to face the first light-emitting member 3. When the second support 4 is in the extended state, the travel switch trigger block 13 is in contact with the travel switch 12 to control the circuit on the second light-emitting member 5 to be conductive with the power circuit on the control circuit board 10. When the second support 4 is in the contracted state, the travel switch trigger block 13 is not in contact with the travel switch 12 so as to control the circuit on the second light-emitting member 5 to be disconnected with the power circuit on the control circuit board 10.

The triggering mechanism formed form the travel switch 12 and the travel switch trigger block 13 has the advantages of simple structure, ease for realizing, and low production cost. In an alternative embodiment, the mounting positions of the travel switch 12 and the travel switch trigger block 13 can also be exchanged.

In summary, the telescopic lamp of the embodiment of the present application have a structural design in which the second support 4 and the first support 2 are slidably connected, and the second light-emitting member 5 and the first light-emitting member 3 are arranged in a staggered manner. When the lamp is required to have a long length for lighting during use, the second support 4 is to the extended state, then the first light-emitting member 3 and the second light-emitting member 5 are arranged in sequence, which can meet the requirement for the length of the lamp for lighting; when storing the lamp, the second support 4 is slid to the contracted state, and the second light-emitting member 5 and the first light-emitting member 3 are stacked in arrangement, which can shorten the overall length of the lamp, especially lamps with an elongated strip shape. Correspondingly, the length of the box for storing such lamp can be shortened, and the lamp is convenient to carry. In addition, the lamp has two different lighting lengths respectively in the contracted state and the extended state, which solves the problem of the prior art that the lighting lamp has a fixed and unadjustable length. Therefore, the lamp of the present application is more practical.

Obviously, the above embodiments are merely for clear illustration of the embodiments, and are not intended to limit the embodiments. Other variations or modifications of the various forms may be made by those skilled in the art in light of the above description. There is no need and no way to exhaust all of the embodiments, and obvious changes or variations derived therefrom still fall within the scope of the present application.

Various embodiments of the invention may be reflected or represented in the following claims:

1. A telescopic lamp, comprising:

a lamp handle (1);

a first support (2), having a first light-emitting member (3) disposed thereon;

a second support (4), extending in the same direction as the first support (2), slidably connected to the first support (2) along a length direction of the first support (2), and having a second light-emitting member (5) mounted thereon;

wherein, the second light-emitting member (5) and the first light-emitting member (3) extend in the same direction and are arranged to be non-coplanar;

during a process of relative sliding of the second support (4) and the first support (2), the second support (4) has a contracted state, in which the second support (4) is stacked on the first support (2), so as to cause the second light emitting member (5) to be stacked on the first light-emitting member (3), and has an extended state, in which the second support (4) extends outwards relative to the first support (2), so as to cause the second light-emitting member (5) and the second light-emitting member (5) to be arranged in sequence along a length direction of the first support (2).

2. The telescopic lamp according to claim 1, characterized in that, the second support (4) has a cavity disposed therein, which extends along a length direction of the second support (4), and the first support (2) is slidably connected with an interior of the cavity of the second support (4);

when the second support (4) is in the contracted state, the first support (2) is received in the cavity, and when the second support (4) is in the extended state, the first support (2) extends out of the cavity.

3. The telescopic lamp according to claim 2, characterized in that, the second support (4) has an elongated semi-cylindrical structure, and the second support (4) comprises a horizontal top surface (402) at a side surface thereof, and the second light emitting element (5) is mounted on the horizontal top surface (402) of the second support (4).

4. The telescopic lamp according to claim 3, characterized in that, the cavity of the second support (4) has a cross-section with a semi-circular shape, and the first support (2) has a cross-section with the same size as the cross section of the cavity of the second support (4).

5. The telescopic lamp according to claim 1, characterized in that, the first support (2) has an elongated cylindrical structure with a mounting cavity provided therein.

6. The telescopic lamp according to any one of claims 1-5, characterized in that, the first light-emitting member (3) is connected to the lamp handle (1) and a receiving gap is arranged between the first light-emitting member (3) and the first support (2);

when the second support (4) is in the contracted state, the second light-emitting member (5) is arranged in the receiving gap and covered by the first light-emitting member (3).

7. The telescopic lamp according to claim 6, characterized in that the horizontal top surface (402) of the second support (4) has a first sliding groove (403) disposed thereon, which extends along the length direction of the first support (2); and the first light-emitting member (3) is provided with a first sliding block (303) slidably connected to the first sliding groove (403) at one side facing the first support (2)

8. The telescopic lamp according to claim 7, characterized in that an outer wall of the first support (2) is provided with a guide groove (201) recessed inwardly and extending along the length direction of the first support (2); and an outer wall of the second support (4) is recessed to form a guide block (404) matching the shape of the guide groove (201).

9. The telescopic lamp according to claim 8, characterized in that the second support (4) further comprises a circular-arc side surface (401), and the guide block (404) is arranged on the circular-arc side surface (401) of the second support (4) and has a cross section with an arc shape.

10. The telescopic lamp according to any one of claims 1-5, characterized in that the first light-emitting member (3) is connected to the first support (2), and when the second support (4) is in the contracted state, the second light-emitting member (5) is arranged over the first light-emitting member (3) to cover the first light-emitting member (3).

11. The telescopic lamp according to claim 1, characterized in that a locking mechanism is arranged between the first support (2) and the second support (4) to lock the second support (4) in the contracted state or the extended state.

12. The telescopic lamp according to claim 11, characterized in that the locking mechanism comprises a lock block structure (6) arranged on the first support (2), and a first lock hole (405) and a second lock hole (406) respectively arranged on opposite ends of the length direction of the second support (4); and the outer wall of the first support (2) is provided with a mounting groove (202), and the lock block structure (6) comprises a first elastic member (61) with one end thereof connected to a bottom of the mounting groove (202) and a snap bead (62) connected to the other end of the first elastic member (61), and the snap bead (62) protrudes from the mounting groove (202) and extends into the first lock hole (405) or the second lock hole (406) to maintain a locking between the second support (4) and the first support (2) under an action of the first elastic member (61), 13. The telescopic lamp according to claim 12, characterized in that a plurality of the first lock holes (405) and the second lock holes (406) are respectively arranged along a circumference and an axis of the second support (4);

a plurality of the lock block structures (6) are also respectively arranged along a circumference and an axis of the first support (2); and the plurality of the lock block structures (6) are arranged in one-to-one correspondence with the plurality of the first lock holes (405) and the plurality of second lock holes (406).

14. The telescopic lamp according to claim 11, characterized in that the locking mechanism comprises a limiting slot (203) arranged on the outer wall of the first support (2), and a first wedge block (407) and a second wedge block (408) respectively arranged on inner walls of opposite ends of the length direction of the second support (4) and having inclined guide surfaces; wherein the first wedge block (407) is arranged to cooperate with the limiting slot (203) to lock the second support (4) in the contracted state, and the second wedge block (408) is arranged to cooperate with the limiting slot (203) to lock the second support (4) in the extended state.

15. The telescopic lamp according to claim 11, characterized in that the locking mechanism comprises an anti-slip member (205) connected to an outer wall of an end of the first support (2) away from the lamp handle (1), and a sleeve (409) connected to an inner wall of one end of the second support (4) close to the lamp handle (1);

the anti-slip member (205) and the sleeve (409) are used to increase sliding damping between the first support (2) and the second support (4); and when the second support (4) is in the extended state, the anti-slip member (205) and the sleeve (409) are limited to abut against with each other to avoid separation of the second support (4) from the first support (2).

16. The telescopic lamp according to claim 15, characterized in that the anti-slip member (205) is provided with a plurality of convex ribs protruding outward at an outer wall thereof.

17. the telescopic lamp according to claim 1, wherein a light emitting surface of the first light emitting element (3) and a light emitting surface of the second light emitting element (5) are located on the same side surface of the lamp.

18. The telescopic lamp according to claim 1, wherein the first light-emitting member (3) and the second light-emitting member (5) both have an elongated shape.

19. The telescopic lamp according to claim 2, characterized in that a second elastic member (7) is provided in the cavity of the second support (4), and the other end of the second elastic member (7) is connected to the first support (2).

20. The telescopic lamp according to claim 6, wherein a circuit of the first light-emitting member is connected to a power circuit, and a triggering mechanism is arranged between the first light-emitting member and the second light-emitting member for controlling conducting or non-conducting between a circuit of the second light-emitting member and the power circuit;

when the second support is in the extended state, the triggering mechanism is triggered to cause the circuit of the second light-emitting member to become conductive with the power circuit;

when the second support is in the contracted state, the triggering mechanism is opened to cause the circuit of the second light-emitting to be disconnected with the power circuit.

21. The telescopic lamp according to claim 20, characterized in that the power circuit is arranged on a control circuit board, and the first light-emitting member and the second light-emitting member both are electrically connected to the control circuit board;

the triggering mechanism comprises a travel switch and a travel switch trigger block, one of the travel switch and the travel switch trigger block is arranged at one end of the first light-emitting member close to the second light-emitting member, and the other is arranged at one end of the second light-emitting member close to the first light-emitting member;

when the second support is in the extended state, the travel switch trigger block contacts the travel switch to control the circuit of the second light-emitting member to become conductive with the power circuit;

when the second support is in a contracted state, the travel switch trigger block is not in contact with the travel switch to control the circuit of the second light-emitting member to be disconnected with the power circuit.

22. The telescopic lamp according to claim 20, characterized in that the triggering mechanism comprises a first electrical contact point (301) arranged on the first light-emitting member (3) and a second electrical contact point (501) arranged on the second light-emitting member (5);

when the second support (4) is in the extended state, the second electrical contact point (501) is in contact with the first electrical contact point (301) to cause the circuit of the second light-emitting member (5) to become conductive with the circuit of the first light-emitting member (3); and when the second support (4) is in the contracted state, the second electrical contact point (501) is out of contact with the first electrical contact point (301).

23. The telescopic lamp according to claim 6, characterized in that a first housing (8) is sleeved on an outer periphery of the first support (2) and the first light-emitting member (3), and a second housing (9) is sleeved on an outer periphery of the second support (4) and the second light-emitting member (5), and the second housing (9) is slidably connected to the first housing (8) and embedded in the first housing (8).

24. The telescopic lamp according to claim 10, characterized in that the lamp handle (1) is rotatably connected to the first support (2) around an axis, and during a process of rotating around the axis, the lamp handle (1) has an unfolding position in which the lamp handle (1) is arranged coaxially with the first support (2) and a folding position in which the lamp handle (1) is folded against an outer side wall of the first support (2).

25. The telescopic lamp according to claim 22, characterized in that a side surface of the lamp handle (1) facing the first support (2) has a first electric contact piece (102) protruding outwardly, and a second electrical contact piece (204) is arranged on a side surface of the first support (2) connected with the lamp handle (1);

when the lamp handle (1) is in the unfolded position, the first electric contact piece (101) is in contact with the second electric contact piece (204).

The invention claimed is:

1. A telescopic lamp, comprising:

a lamp handle (1);

a first support (2), having a first light-emitting member (3) disposed thereon;

a second support (4), extending in the same direction as the first support (2), slidably connected to the first support (2) along a length direction of the first support (2), and having a second light-emitting member (5) mounted thereon;

wherein, the second light-emitting member (5) and the first light-emitting member (3) extend in the same direction and are arranged to be non-coplanar;

during a process of relative sliding of the second support (4) and the first support (2), the second support (4) has a contracted state, in which the second support (4) is stacked on the first support (2), so as to cause the second light-emitting member (5) to be stacked on the first light-emitting member (3), and has an extended state, in which the second support (4) extends outwards relative to the first support (2), so as to cause the second light-emitting member (5) and the second light-emitting member (5) to be arranged in sequence along a length direction of the first support (2);

a locking mechanism is arranged between the first support (2) and the second support (4) to lock the second support (4) in the contracted state or the extended state; and a light-emitting surface of the first light-emitting element (3) and a light-emitting surface of the second light-emitting element (5) are located on the same side surface of the lamp.

2. The telescopic lamp according to claim 1, wherein the second support (4) comprises a cavity disposed therein, which extends along a length direction of the second support (4), and the first support (2) is slidably connected with an interior of the cavity of the second support (4);

when the second support (4) is in the contracted state, the first support (2) is received in the cavity, and when the second support (4) is in the extended state, the first support (2) extends out of the cavity.

3. The telescopic lamp according to claim 2, wherein:

the second support (4) comprises an elongated semi-cylindrical structure;

the second support (4) comprises a horizontal top surface (402) at a side surface thereof; or the second light-emitting element (5) is mounted on the horizontal top surface (402) of the second support (4).

4. The telescopic lamp according to claim 3, wherein the cavity of the second support (4) has a cross-section with a semi-circular shape, and the first support (2) comprises a cross-section with the same size as the cross section of the cavity of the second support (4) and an elongated cylindrical structure with a mounting cavity provided therein.

5. The telescopic lamp according to claim 1, wherein:

the first light-emitting member (3) is connected to the lamp handle (1) and a receiving gap is arranged between the first light-emitting member (3) and the first support (2);

when the second support (4) is in the contracted state, the second light-emitting member (5) is arranged in the receiving gap and covered by the first light-emitting member (3):

the first light-emitting member (3) and the second light-emitting member (5) both have an elongated shape;

the first light-emitting member (3) is connected to the first support (2); or when the second support (4) is in the contracted state, the second light-emitting member (5) is arranged over the first light-emitting member (3) to cover the first light-emitting member (3).

6. The telescopic lamp according to claim 5, wherein the horizontal top surface (402) of the second support (4) has a first sliding groove (403) disposed thereon, which extends along the length direction of the first support (2); and the first light-emitting member (3) is provided with a first sliding block (303) slidably connected to the first sliding groove (403) at one side facing the first support (2).

7. The telescopic lamp according to claim 5, further comprising:

a circuit of the first light-emitting member being connected to a power circuit, and a triggering mechanism being arranged between the first light-emitting member and the second light-emitting member for controlling conducting or non-conducting between a circuit of the second light-emitting member and the power circuit;

when the second support is in the extended state, the triggering mechanism is triggered to cause the circuit of the second light-emitting member to become conductive with the power circuit;

when the second support is in the contracted state, the triggering mechanism is opened to cause the circuit of the second light-emitting to be disconnected with the power circuit;

a first housing (8) being sleeved on an outer periphery of the first support (2) and the first light-emitting member (3), and a second housing (9) being sleeved on an outer periphery of the second support (4) and the second light-emitting member (5), or wherein the second housing (9) is slidably connected to the first housing (8) and embedded in the first housing (8).

8. The telescopic lamp according to claim 7, wherein the power circuit is arranged on a control circuit board, and the first light-emitting member and the second light-emitting member both are electrically connected to the control circuit board;

the triggering mechanism comprises a travel switch and a travel switch trigger block, one of the travel switch and the travel switch trigger block is arranged at one end of the first light-emitting member close to the second light-emitting member, and the other is arranged at one end of the second light-emitting member close to the first light-emitting member;

when the second support is in the extended state, the travel switch trigger block contacts the travel switch to control the circuit of the second light-emitting member to become conductive with the power circuit; or when the second support is in a contracted state, the travel switch trigger block is not in contact with the travel switch to control the circuit of the second light-emitting member to be disconnected with the power circuit.

9. The telescopic lamp according to claim 7, wherein:

the triggering mechanism comprises a first electrical contact point (301) arranged on the first light-emitting member (3) and a second electrical contact point (501) arranged on the second light-emitting member (5);

when the second support (4) is in the extended state, the second electrical contact point (501) is in contact with the first electrical contact point (301) to cause the circuit of the second light-emitting member (5) to become conductive with the circuit of the first light-emitting member (3); or when the second support (4) is in the contracted state, the second electrical contact point (501) is out of contact with the first electrical contact point (301).

10. The telescopic lamp according to claim 9, further comprising a side surface of the lamp handle (1) facing the first support (2) comprises a first electric contact piece (102) protruding outwardly, and a second electrical contact piece (204) is arranged on a side surface of the first support (2) connected with the lamp handle (1); or when the lamp handle (1) is in the unfolded position, the first electric contact piece (101) is in contact with the second electric contact piece (204).

11. The telescopic lamp according to claim 6, further comprising an outer wall of the first support (2) being provided with a guide groove (201) recessed inwardly and extending along the length direction of the first support (2); and an outer wall of the second support (4) is recessed to form a guide block (404) matching the shape of the guide groove (201).

12. The telescopic lamp according to claim 11, wherein the second support (4) further comprises a circular-arc side surface (401), and the guide block (404) is arranged on the circular-arc side surface (401) of the second support (4) and has a cross section with an arc shape.

13. The telescopic lamp according to claim 1, wherein the locking mechanism comprises a lock block structure (6) arranged on the first support (2), and a first lock hole (405) and a second lock hole (406) respectively arranged on opposite ends of the length direction of the second support (4); and the outer wall of the first support (2) is provided with a mounting groove (202), and the lock block structure (6) comprises a first elastic member (61) with one end thereof connected to a bottom of the mounting groove (202) and a snap bead (62) connected to the other end of the first elastic member (61), and the snap bead (62) protrudes from the mounting groove (202) and extends into the first lock hole (405) or the second lock hole (406) to maintain a locking between the second support (4) and the first support (2) under an action of the first elastic member (61).

14. The telescopic lamp according to claim 13, further comprising a plurality of the first lock holes (405) and the second lock holes (406) are respectively arranged along a circumference and an axis of the second support (4);

a plurality of the lock block structures (6) are also respectively arranged along a circumference and an axis of the first support (2); and the plurality of the lock block structures (6) are arranged in one-to-one correspondence with the plurality of the first lock holes (405) and the plurality of second lock holes (406).

15. The telescopic lamp according to claim 1, wherein the locking mechanism comprises a limiting slot (203) arranged on the outer wall of the first support (2), and a first wedge block (407) and a second wedge block (408) respectively arranged on inner walls of opposite ends of the length direction of the second support (4) and having inclined guide surfaces; wherein the first wedge block (407) is arranged to cooperate with the limiting slot (203) to lock the second support (4) in the contracted state, and the second wedge block (408) is arranged to cooperate with the limiting slot (203) to lock the second support (4) in the extended state.

16. The telescopic lamp according to claim 1, wherein the locking mechanism comprises an anti-slip member (205) connected to an outer wall of an end of the first support (2) away from the lamp handle (1), and a sleeve (409) connected to an inner wall of one end of the second support (4) close to the lamp handle (1);

the anti-slip member (205) and the sleeve (409) are used to increase sliding damping between the first support (2) and the second support (4); and when the second support (4) is in the extended state, the anti-slip member (205) and the sleeve (409) are limited to abut against with each other to avoid separation of the second support (4) from the first support (2).

17. The telescopic lamp according to claim 16, wherein the anti-slip member (205) is provided with a plurality of conveX ribs protruding outward at an outer wall thereof.

18. The telescopic lamp according to claim 2, further comprising a second elastic member (7) is provided in the cavity of the second support (4), and the other end of the second elastic member (7) is connected to the first support (2).

19. A telescopic lamp, comprising:

a lamp handle (1);

a first support (2), having a first light-emitting member (3) disposed thereon;

a second support (4), extending in the same direction as the first support (2), slidably connected to the first support (2) along a length direction of the first support (2), and having a second light-emitting member (5) mounted thereon;

wherein, the second light-emitting member (5) and the first light-emitting member (3) extend in the same direction and are arranged to be non-coplanar;

during a process of relative sliding of the second support (4) and the first support (2), the second support (4) has a contracted state, in which the second support (4) is stacked on the first support (2), so as to cause the second light-emitting member (5) to be stacked on the first light-emitting member (3), and has an extended state, in which the second support (4) extends outwards relative to the first support (2), so as to cause the second light-emitting member (5) and the second light-emitting member (5) to be arranged in sequence along a length direction of the first support (2);

wherein:

the first light-emitting member (3) is connected to the lamp handle (1) and a receiving gap is arranged between the first light-emitting member (3) and the first support (2);

when the second support (4) is in the contracted state, the second light-emitting member (5) is arranged in the receiving gap and covered by the first light-emitting member (3):

the first light-emitting member (3) and the second light-emitting member (5) both have an elongated shape;

the first light-emitting member (3) is connected to the first support (2); or when the second support (4) is in the contracted state, the second light-emitting member (5) is arranged over the first light-emitting member (3) to cover the first light-emitting member (3);

a circuit of the first light-emitting member being connected to a power circuit, and a triggering mechanism being arranged between the first light-emitting member and the second light-emitting member for controlling conducting or non-conducting between a circuit of the second light-emitting member and the power circuit;

when the second support is in the extended state, the triggering mechanism is triggered to cause the circuit of the second light-emitting member to become conductive with the power circuit;

when the second support is in the contracted state, the triggering mechanism is opened to cause the circuit of the second light-emitting to be disconnected with the power circuit;

a first housing (8) being sleeved on an outer periphery of the first support (2) and the first light-emitting member (3), and a second housing (9) being sleeved on an outer periphery of the second support (4) and the second light-emitting member (5), or wherein the second housing (9) is slidably connected to the first housing (8) and embedded in the first housing (8).

* * * * *